US012674304B2

(12) United States Patent
Chiba et al.

(10) Patent No.: US 12,674,304 B2
(45) Date of Patent: Jul. 7, 2026

(54) WORK MACHINE

(71) Applicant: HITACHI CONSTRUCTION MACHINERY CO., LTD., Tokyo (JP)

(72) Inventors: Takaaki Chiba, Tsuchiura (JP); Masamichi Ito, Toride (JP); Koji Shiwaku, Tsuchiura (JP); Shinya Kasai, Kashiwa (JP); Morizo Henmi, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 211 days.

(21) Appl. No.: 18/037,599

(22) PCT Filed: Nov. 15, 2021

(86) PCT No.: PCT/JP2021/041904
§ 371 (c)(1),
(2) Date: May 18, 2023

(87) PCT Pub. No.: WO2022/107718
PCT Pub. Date: May 27, 2022

(65) Prior Publication Data

US 2024/0011251 A1 Jan. 11, 2024

(30) Foreign Application Priority Data

Nov. 19, 2020 (JP) ..... 2020-192318

(51) Int. Cl.
*E02F 9/26* (2006.01)
*E02F 3/43* (2006.01)

(52) U.S. Cl.
CPC ..... *E02F 9/262* (2013.01); *E02F 9/265* (2013.01); *E02F 3/435* (2013.01)

(58) Field of Classification Search
CPC ..... E02F 9/262; E02F 9/26; E02F 9/24; E02F 9/2033; G05D 1/0297; G05D 1/00;
(Continued)

(56) References Cited

U.S. PATENT DOCUMENTS 6,246,932 B1 * 6/2001 Kageyama ..... G05D 1/0297 701/50
2019/0015987 A1 * 1/2019 Schwarz ..... B25J 9/1633
(Continued)

FOREIGN PATENT DOCUMENTS

CN 203490506 U * 3/2014 ..... G05B 19/19
CN 105487551 A * 4/2016 ..... G05D 1/10
(Continued)

OTHER PUBLICATIONS

International Search Report of PCT/JP2021/041904 dated Dec. 14, 2021.

*Primary Examiner* — Yuri Kan
(74) *Attorney, Agent, or Firm* — MATTINGLY & MALUR, PC

(57) ABSTRACT

Provided is a work machine including a controller configured to perform area restriction control for preventing a vehicle body from deviating from a work area set in a construction area. In this work machine, it is possible to easily set an area for which operation of the work machine is to be restricted in an actual space to a desired position, and to avoid displacement of the area for which the work machine is to be actually controlled from the set area. The work machine includes a controller configured to perform area restriction control for restricting operation of a vehicle body so as to prevent the vehicle body from deviating from a work area set in a construction area. The controller sets at
(Continued)

least a part of the work area based on design data representing a final intended shape of a construction target in the construction area.

17 Claims, 22 Drawing Sheets

(58) Field of Classification Search
CPC ..... B25J 9/1633; A01B 69/00; B60T 13/662; G05B 19/19; B66C 23/86
See application file for complete search history.

(56) References Cited

U.S. PATENT DOCUMENTS

| | | | |
|---|---|---|---|
| 2019/0360835 | A1 | 11/2019 | Gariepy et al. |
| 2021/0230837 | A1 | 7/2021 | Narikawa et al. |
| 2021/0230841 | A1 | 7/2021 | Kurosawa |
| 2022/0049474 | A1 | 2/2022 | Kanazawa et al. |
| 2022/0136211 | A1 | 5/2022 | Moriki et al. |

FOREIGN PATENT DOCUMENTS

| | | | | | |
|---|---|---|---|---|---|
| DE | 102016005317 | A1 | * | 11/2017 | ..... B60T 13/662 |
| JP | 09-71965 | A | | 3/1997 | |
| JP | 2019115267 | A | * | 7/2019 | ..... A01B 69/00 |
| JP | 2019157409 | A | * | 9/2019 | ..... B66C 23/86 |
| JP | 2020-041388 | A | | 3/2020 | |
| JP | 2020-117982 | A | | 8/2020 | |
| JP | 2020-159027 | A | | 10/2020 | |
| KR | 101797261 | B1 | * | 9/2013 | ..... E02F 9/26 |
| WO | 2020/080538 | A1 | | 4/2020 | |
| WO | 2020/195262 | A1 | | 10/2020 | |

* cited by examiner

WORK MACHINE

TECHNICAL FIELD

The present invention relates to a work machine.

BACKGROUND ART

For a work machine such as a hydraulic excavator, there is known area restriction control for controlling a work implement such that the work implement will not deviate from a work area set in advance, such as height, depth, turning angle or the like (Patent Literature 1).

Using such area restriction control allows an operator to conduct operations without being conscious of the likelihood that the work implement will contact and destroy electric wires or underground objects, and thus the work efficiency may be improved. In addition, restriction of the area in a turning direction can prevent the work implement from going into a road during operation on the roadside of the road or the like, and the safety may be improved.

In the area restriction control for the work machine as described in Patent Literature 1, however, an area to be set is specified by coordinates based on the vehicle body, and thus movement of the work machine through traveling operation or the like may cause displacement of an area to be actually restricted from the area set based on the vehicle body. This may lead to reduction of the work efficiency for the operator or reduction of the safety.

Meanwhile, according to Patent Literature 2, a hydraulic excavator capable of acquiring information about the position of the vehicle body resets a turning angle to be restricted according to the information about the position of the vehicle body based on map data that is data including previously inputted coordinate information on the area for which entry and contact are prohibited (target to be controlled), such as roads and buildings within a construction area. With this configuration, even if the work machine moves through traveling operation, it is possible to reset the turning angle to be restricted for the area for which entry of the work machine is not intended, such as roads. This can avoid displacement of the area to be actually restricted from such an area under control.

CITATION LIST

Patent Literature

Patent Literature 1: JP H9-71965 A
Patent Literature 2: JP 2019-157409 A

SUMMARY OF INVENTION

Technical Problem

However, the area restriction control for restricting the operation of the work machine may include not only a case where an operator sets an area for a target that can be set in advance, such as roads or the like in the map data, but also a case where the operator sets in real time an area for any passageway for workers prepared at a construction site and the like. In such a situation, even with the technique described in Patent Literature 2, movement of the vehicle body through the traveling operation may cause displacement of the area for which entry is to be actually avoided from the area under control.

The present invention aims to provide a work machine including a controller configured to perform area restriction control for preventing a vehicle body from deviating from a work area set in a construction area. In this work machine, it is possible to easily set an area for which operation of the work machine is to be restricted in an actual space to a desired position, and to avoid displacement of the area for which the work machine is to be actually controlled from the set area.

Solution to Problem

To solve the above issues, the work machine of the present invention is a work machine including a controller configured to perform area restriction control for restricting operation of a vehicle body so as to prevent the vehicle body from deviating from a work area set in a construction area. The controller is configured to; set at least a part of the work area based on design data representing a final intended shape of a construction target in the construction area; be able to further set an entry-prohibited area for which entry of the vehicle body is avoided based on the design data; and prohibit setting, as a work area, an entry-prohibited area that has already been set. In addition, the work machine of the present invention is a work machine including a controller configured to perform area restriction control for restricting operation of a vehicle body so as to prevent the vehicle body from deviating from a work area set in a construction area. The controller is configured to: set at least a part of the work area based on design data representing a final intended shape of a construction target in the construction area; be able to further set an entry-prohibited area for which entry of the vehicle body is avoided based on the design data; and when a work area set in advance is set as an entry-prohibited area, overwrite the work area with the entry-prohibited area.

Advantageous Effects of Invention

According to the present invention, provided is a work machine including a controller configured to perform area restriction control for preventing a vehicle body from deviating from a work area set in a construction area. In this work machine, it is possible to easily set an area for which operation of the work machine is to be restricted in an actual space to a desired position, and to avoid displacement of the area for which the work machine is to be actually controlled from the set area.

Other issues, configurations, and advantageous effects will become apparent from the following description of an embodiment.

DESCRIPTION OF EMBODIMENTS

Figure 1:
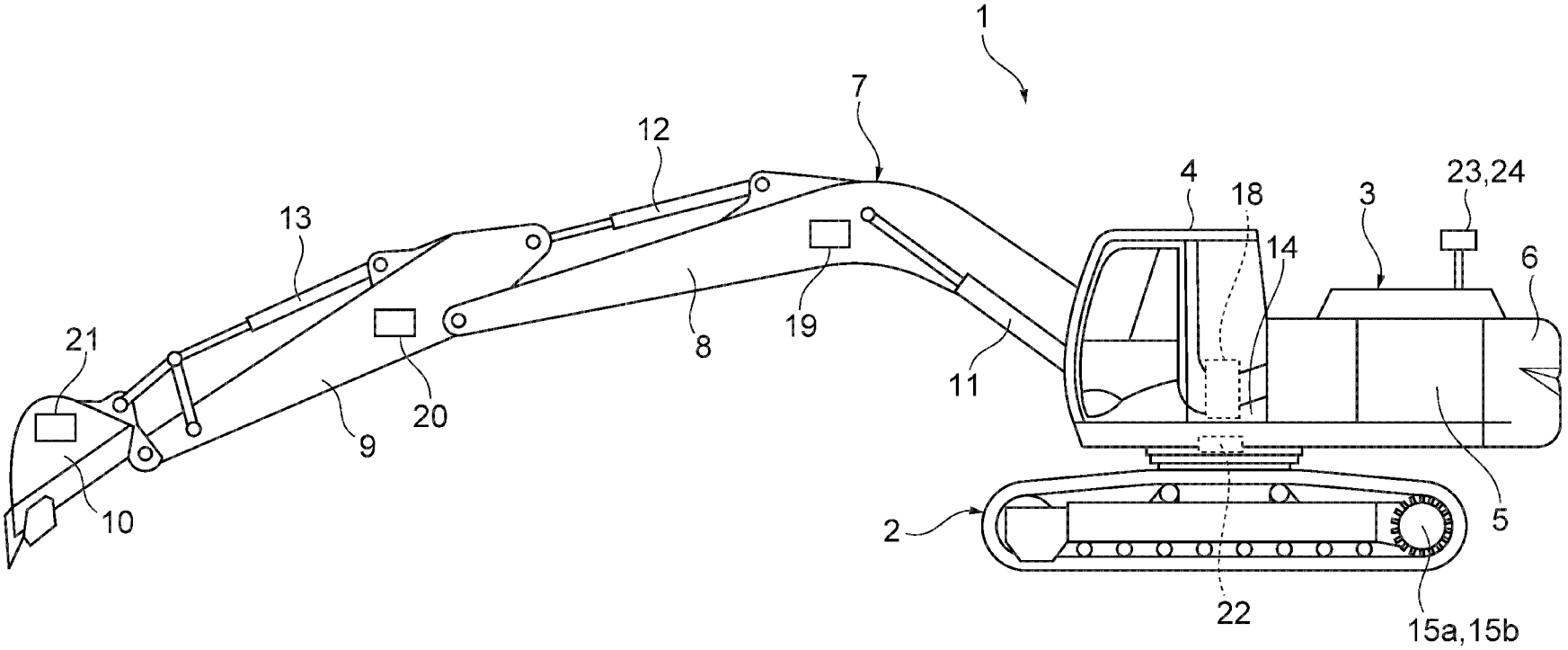
FIG. 1 is a side view of a hydraulic excavator according to an embodiment.

The following describes an embodiment of the present invention with reference to the drawings. In each drawing, the same reference numeral is given to a part having the same function and the repeated description is omitted in some cases. The present embodiment exemplifies a work machine to be controlled by way of a hydraulic excavator. However, the present embodiment is applicable to work machines other than a hydraulic excavator, such as wheel loaders and cranes, as long as area restriction control for restricting operation of a vehicle body can be performed so as to prevent the vehicle body from deviating from a work area set in a construction area.

FIG. 1 is a side view of a hydraulic excavator 1 that is an example of a work machine according to an embodiment. The hydraulic excavator 1 includes a traveling body 2 that travels by driving tracks provided on its right and left side portions and a turning body 3 mounted on the traveling body 2 so as to be able to turn.

The turning body 3 includes a cab 4, a machine room 5, and a counterweight 6. The cab 4 is provided on the left side portion of the front part of the turning body 3. The machine room 5 is provided behind the cab 4. The counterweight 6 is provided behind the machine room 5, that is, at the rear end of the turning body 3.

In addition, the turning body 3 is equipped with a work implement 7. The work implement 7 is provided on the right side of the cab 4, at the center of the front part of the turning body 3. The work implement 7 includes a boom 8, an arm 9, a bucket 10, a boom cylinder 11, an arm cylinder 12, and a bucket cylinder 13. The proximal end of the boom 8 is pivotably attached to the front part of the turning body 3 via a boom pin. The proximal end of the arm 9 is pivotably attached to the distal end of the boom 8 via an arm pin. The proximal end of the bucket 10 is pivotably attached to the distal end of the arm 9 via a bucket pin. The boom cylinder 11, the arm cylinder 12, and the bucket cylinder 13 are hydraulic cylinders that are driven by hydraulic oil. The boom cylinder 11 drives the boom 8. The arm cylinder 12 drives the arm 9. The bucket cylinder 13 drives the bucket 10.

A turning motor 14 is disposed at the center of the turning body 3. Driving the turning motor 14 allows the turning body 3 to rotate (turn) with respect to the traveling body 2.

A left-side traveling motor 15*a* and a right-side traveling motor 15*b* are disposed in the traveling body 2. By driving the traveling motors (15*a*, 15*b*) on the right and left sides, the traveling body 2 can travel by driving the tracks on the right and left sides.

In the following, the boom cylinder 11 for driving the boom, the arm cylinder 12 for driving the arm, the bucket cylinder 13 for driving the bucket, the turning motor 14 for turning operation, and the left-side traveling motor 15*a* and the right-side traveling motor 15*b* for traveling operation may be referred to as the actuators of the hydraulic excavator 1. The traveling body 2 and the turning body 3 may collectively be referred to as the vehicle body of the hydraulic excavator 1. The vehicle body may or may not include the work implement 7 attached to the turning body 3.

Figure 2:
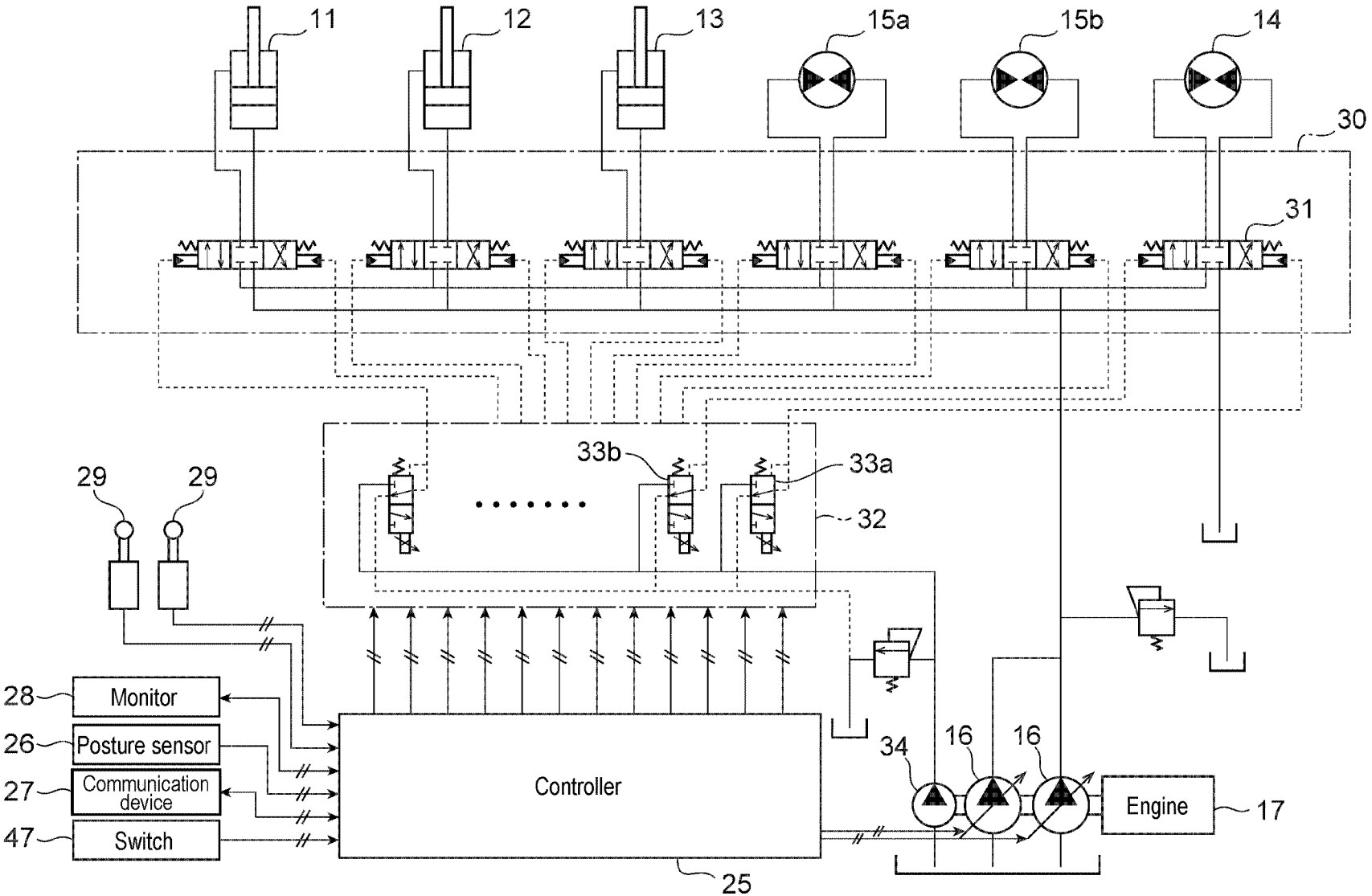
FIG. 2 is a diagram showing a system configuration of the hydraulic excavator.

A hydraulic pump 16 and an engine (prime mover) 17 are disposed inside of the machine room 5 (see FIG. 2).

A body inclination sensor 18 is attached to the inside of the cab 4. A boom inclination sensor 19, an arm inclination sensor 20, and a bucket inclination sensor 21 are attached to the boom 8, the arm 9, and the bucket 10, respectively. For example, the body inclination sensor 18, the boom inclination sensor 19, the arm inclination sensor 20, and the bucket inclination sensor 21 are IMUs (Inertial Measurement Units). The body inclination sensor 18 measures a ground angle of the vehicle body. The boom inclination sensor 19 measures a ground angle of the boom 8. The arm inclination sensor 20 measures a ground angle of the arm 9. The bucket inclination sensor 21 measures a ground angle of the bucket 10. A turning angle sensor 22 is attached to the turning center of the turning body 3, and a relative angle of the turning body 3 relative to the traveling body 2 can be obtained based on a signal from the turning angle sensor 22. In addition, a first GNSS antenna 23 and a second GNSS antenna 24 are attached to the rear portion of the turning body 3 on the right and left sides. The information about the position and orientation of the vehicle body can be acquired based on signals obtained from the first GNSS antenna 23 and the second GNSS antenna 24.

FIG. 2 is a diagram showing a system configuration of the hydraulic excavator 1.

The hydraulic excavator 1 is driven by the actuators (11, 12, 13, 14, 15*a*, 15*b*) supplied with hydraulic oil ejected from the hydraulic pump 16 driven by the engine 17. The amount and direction of the oil supplied to the actuator can be controlled by driving a flow rate control valve in a flow rate control valve unit 30.

For example, a turning flow rate control valve 31 is a flow rate control valve for controlling the amount of oil supplied to the turning motor 14. When the turning flow rate control valve 31 moves to the left in the drawing, oil is supplied so as to rotate the turning motor 14 in the left direction. The rotation speed of the turning motor 14 can be controlled according to a movement amount of the turning flow rate control valve 31. When the turning flow rate control valve 31 moves to the right in the drawing, oil is supplied so as to rotate the turning motor 14 in the right direction.

The turning flow rate control valve 31 is controlled by controlling a solenoid proportional pressure reducing valve in a solenoid proportional pressure reducing valve unit 32. The solenoid proportional pressure reducing valve decompresses the oil supplied from a pilot pump 34 and supplies it to the flow rate control valve in response to a command from a controller 25.

For example, when a leftward turning solenoid proportional pressure reducing valve 33*a* is driven, pressure oil is supplied so as to move the turning flow rate control valve 31 to the left in the drawing, and when a rightward turning solenoid proportional pressure reducing valve 33*b* is driven, pressure oil is supplied so as to move the turning flow rate control valve 31 to the right in the drawing.

Though not shown in the drawings, the controller 25 is configured as a computer including a CPU (Central Processing Unit) that executes various operations, a storage unit such as a ROM (Read Only Memory), a HDD (Hard Disk Drive), or the like that stores programs for executing the operations by the CPU, a RAM (Random Access Memory) serving as a work area when the CPU executes the programs, and the like. The CPU loads various programs stored in the storage unit into the RAM and executes the programs so that the functions of the controller 25 are implemented.

In the present embodiment, the controller 25 that is a control device for controlling the hydraulic excavator 1 performs area restriction control for restricting operation of the vehicle body so as to prevent the vehicle body from deviating from a work area set in a construction area.

The controller 25 calculates and outputs control signals to the solenoid proportional pressure reducing valve unit 32 and the hydraulic pump 16 based on a signal from a control lever 29, a signal from a monitor 28, signals from a posture sensor 26 including the turning angle sensor 22 and the like, a signal from a communication device 27, and a signal from a switch 47.

The control lever 29, the monitor 28, and the switch 47 are disposed inside of the cab 4 or on a construction management server or the like, for example, and can be operated by an operator or the like. The control lever 29 instructs the operation amounts of the actuators (11, 12, 13, 14, 15*a*, 15*b*) to the controller 25. The monitor 28 is used for setting a work area and an entry-prohibited area (described later) for the area restriction control.

The posture sensor 26 includes the body inclination sensor 18, the boom inclination sensor 19, the arm inclination sensor 20, the bucket inclination sensor 21, the turning angle sensor 22, the first GNSS antenna 23, and the second GNSS antenna 24 as described above. Based on the signals obtained therefrom, posture information (position information, orientation information, inclination information) about the vehicle body can be acquired. The signals from the posture sensor 26 (posture information) are inputted to the controller 25.

The communication device 27 receives information about a work area and an entry-prohibited area set by other work machines (other machines) or the like and transmits information about a work area and an entry-prohibited area set by an own machine to the construction management server or the other work machines.

The switch 47 is a switch (switching device) for switching between a work area setting mode for setting a work area based on design data (described later) and a work area setting mode for setting a work area based on the position of the vehicle body irrespective of the design data. A signal from the switch 47 is inputted to the controller 25, and then based on the signal from the switch 47, the controller 25 changes and displays the work area setting screen on the monitor 28. Although the work area setting mode is changed by the switch 47 herein, the monitor 28 may be used as a switching device for switching the work area setting mode, and the work area setting mode may be changed on the setting screen displayed on the monitor 28, for example.

Figure 3:
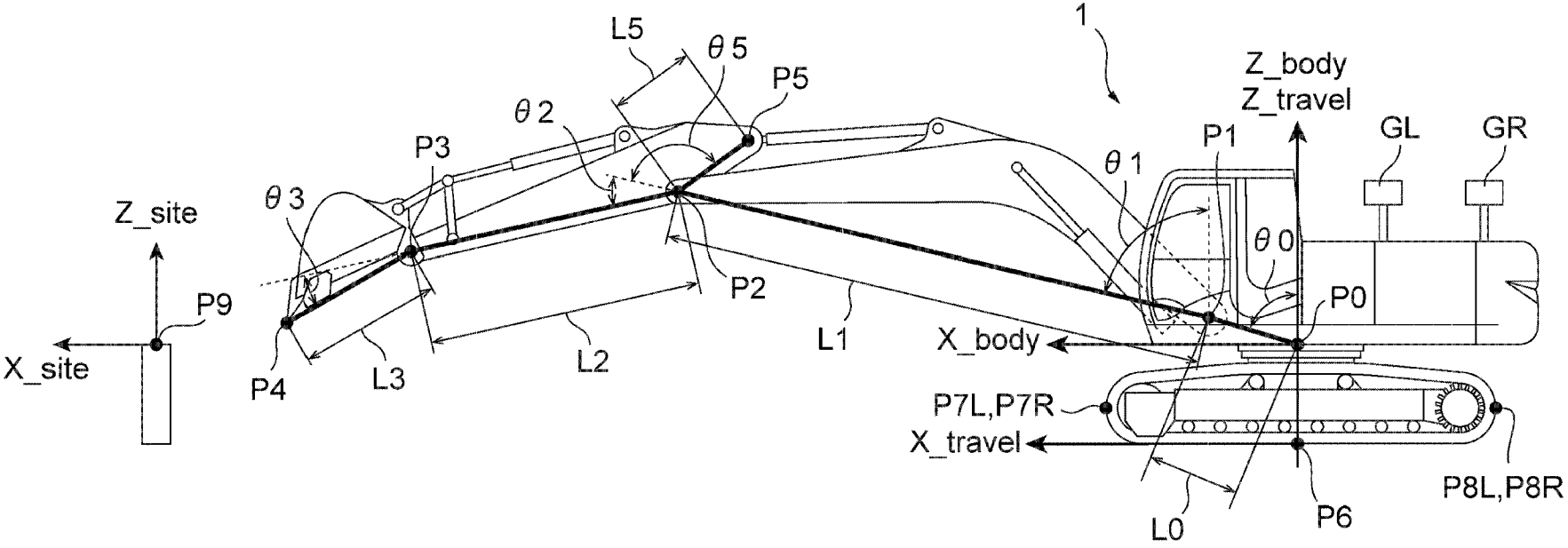
FIG. 3 is a side view according to posture information on the hydraulic excavator.

FIG. 3 is a side view showing posture information on the hydraulic excavator 1. Position information (also referred to as vehicle body position) P0 of the hydraulic excavator 1 in a site coordinate system can be obtained from position information GL of the first GNSS antenna 23 and position information GR of the second GNSS antenna 24. The site coordinate system is a three-dimensional coordinate system based on a reference position P9 set in an operation area. As shown in FIG. 3, the reference position P9 is an end of a reference peg set in the operation area, for example.

As shown in FIG. 3, in a turning body coordinate system, the distance from the position information P0 to a boom pin P1 of the hydraulic excavator 1 is L0, and the angle defined by the upward direction of the vehicle body and the direction of the boom pin P1 is θ0. The length of the boom 8, that is, the length from the boom pin P1 to the arm pin P2 is L1. The length of the arm 9, that is, the length from the arm pin P2 to the bucket pin P3 is L2. The length of the bucket 10, that is, the length from the bucket pin P3 to the bucket end P4 is L3. The angle defined by the line segment connecting the boom pin P1 and the arm pin P2 and the vertical direction of the vehicle body is θ1. Hereinafter, this will be referred to as a boom angle θ1. The angle defined by the line segment connecting the arm pin P2 and the bucket pin P3 and the straight line formed by the boom pin P1 and the arm pin P2 is θ2. Hereinafter, this will be referred to as an arm angle θ2. The angle defined by the line segment connecting the bucket pin P3 and the bucket end P4 and the straight line formed by the arm pin P2 and the bucket pin P3 is θ3. Hereinafter, this will be referred to as a bucket angle θ3. Herein, the turning body coordinate system represents three-dimensional coordinates based on the turning body 3 of the hydraulic excavator 1, where the reference position P0 is set at the turning center of the turning body 3.

In the turning body coordinate system, coordinates of the bucket end P4, that is, a point to be controlled by the area restriction control with respect to the vehicle body position P0, can be obtained using trigonometric functions from the distance L0 between the vehicle body position P0 and the boom pin P1, the angle θ0 between the vehicle body position P0 and the boom pin P1, the boom length L1, the boom angle θ1, the arm length L2, the arm angle θ2, the bucket length L3, and the bucket angle θ3.

Coordinates of the other control points, for example, coordinates of the pin P5 on the rod side of the arm cylinder 12, can be obtained using trigonometric functions using the distance L5 between the arm pin P2 and the pin P5 on the rod side of the arm cylinder 12, and the angle θ5 defined by the direction from the boom pin P1 to the arm pin P2 and the direction from the arm pin P2 to the pin P5 on the rod side of the arm cylinder 12, in addition to the above-mentioned dimensions.

In the turning body coordinate system, the control points P7L, P7R, P8L, P8R on the traveling body 2 can be calculated based on a turning angle θsw (FIG. 4) that is a relative angle of the turning body 3 relative to the traveling body 2, and the relative coordinates of the control points P7L, P7R, P8L, P8R relative to the vehicle body position P0. Herein, the turning angle θsw represents a rotation amount in the z direction of the turning body coordinate system and a traveling body coordinate system. The traveling body coordinate system represents three-dimensional coordinates centered around the coordinates P6 as an intersection of the lower part of the traveling body 2 and the turning center.

Figure 4:
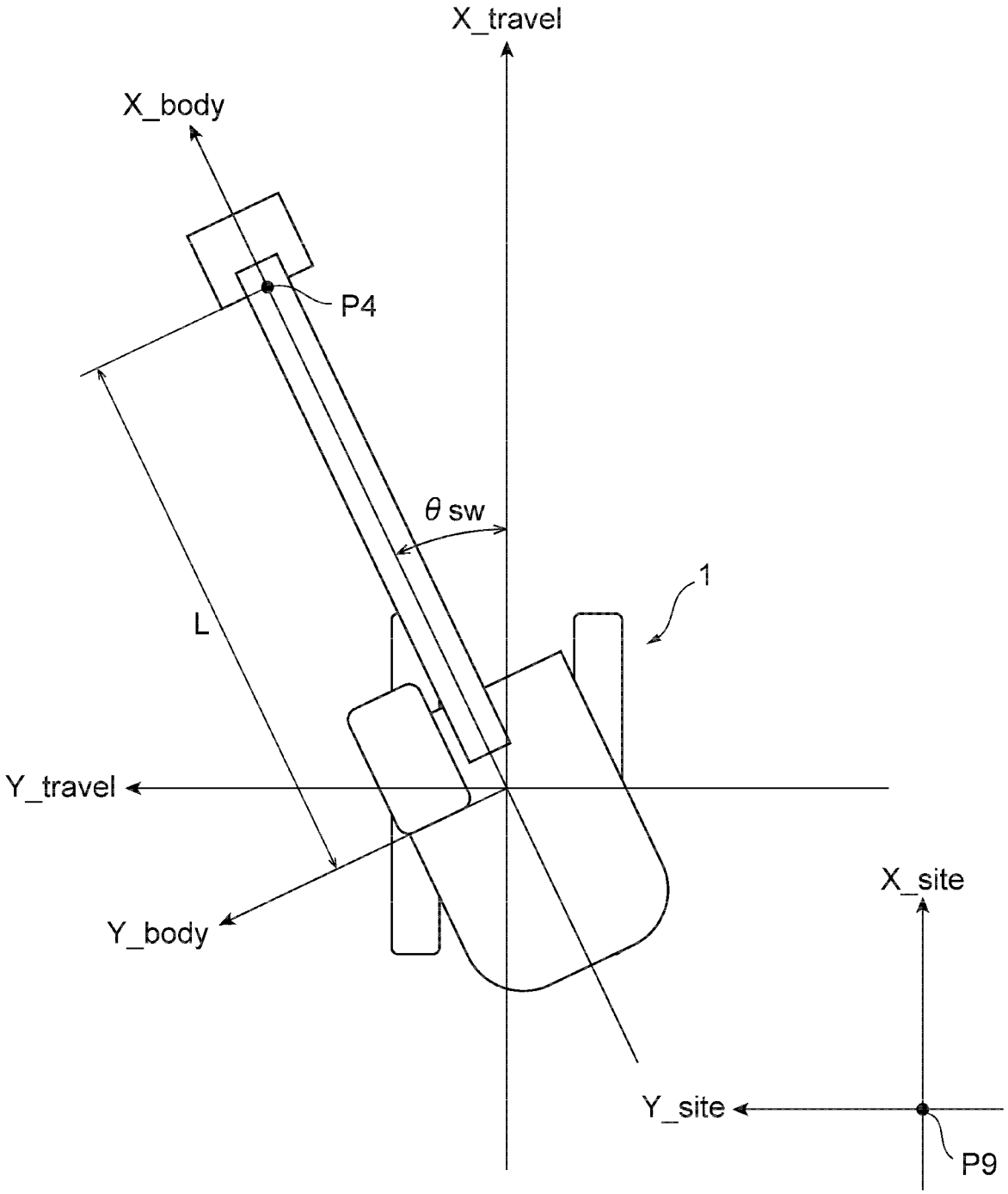
FIG. 4 is a top view according to posture information on the hydraulic excavator.

FIG. 4 is a top view showing posture information on the hydraulic excavator 1. In the turning body coordinate system, a direction of the work implement is the x direction based on the turning center. In the traveling body coordinate system, a forward traveling direction is the x direction based on the turning center. The turning angle θsw of the hydraulic excavator 1 is defined as a rotation amount of the traveling body coordinates with respect to the turning body coordinates with a counterclockwise direction being a positive direction.

In the site coordinate system, coordinates of each control point in the turning body coordinate system can be calculated through coordinate transformation if one knows a vehicle body position P0 in the site coordinate system and a rotation angle (roll angle, pitch angle, yaw angle) in the turning body coordinate system with respect to the site coordinate system. The yaw angle can be acquired by calculating an orientation of the vehicle body with respect to the reference orientation in the site coordinate system from the position information obtained by the GNSS. The roll angle and the pitch angle can be acquired from the body inclination sensor 18.

In this way, the posture information on the vehicle body (or each control point thereof) can be acquired from the information obtained by the posture sensor 26 including the body inclination sensor 18, the boom inclination sensor 19, the arm inclination sensor 20, the bucket inclination sensor 21, the turning angle sensor 22, the first GNSS antenna 23, and the second GNSS antenna 24.

Figure 5:
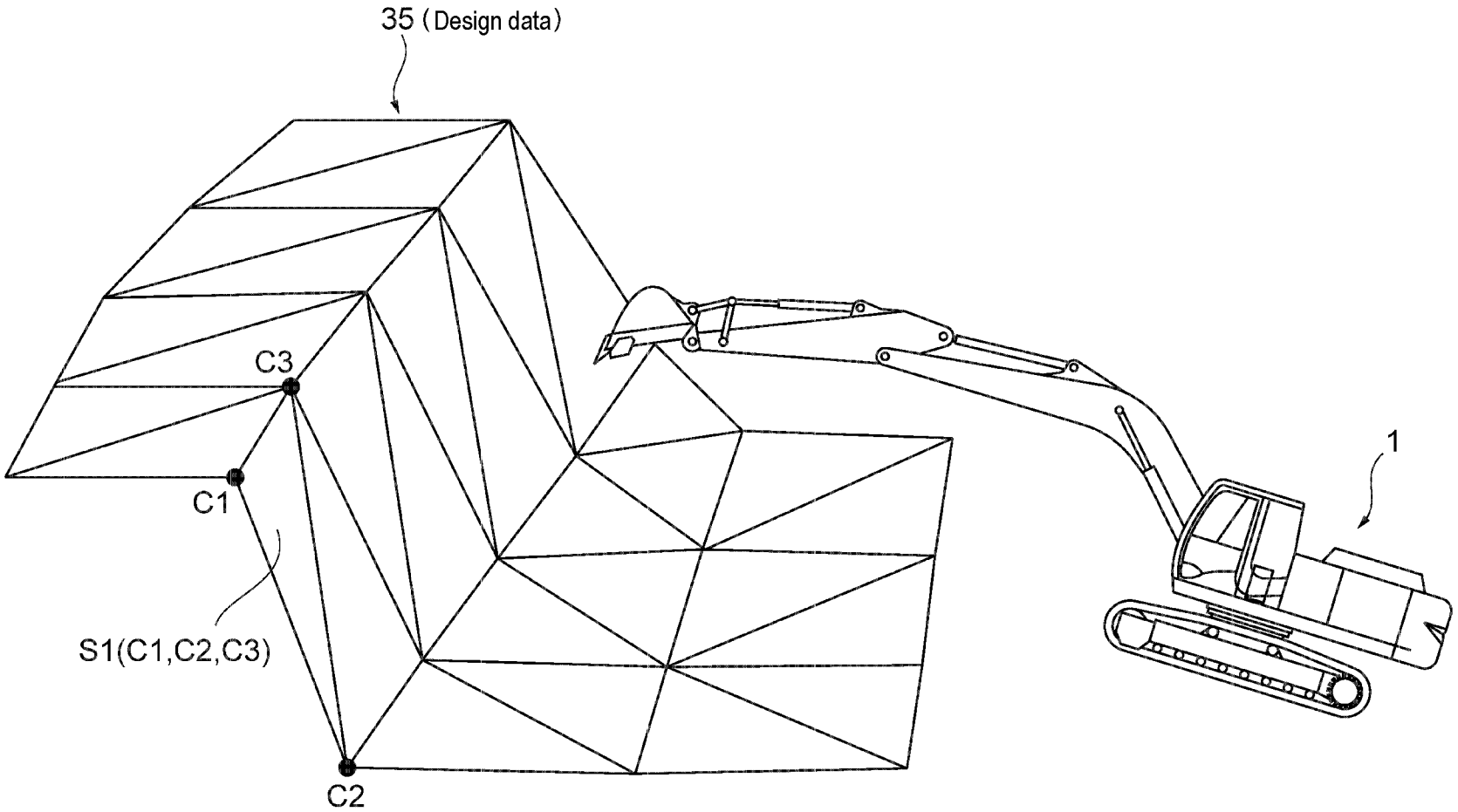
FIG. 5 is a view of design data representing an intended surface shape.

FIG. 5 is a view of design data representing an intended surface shape. Design data 35 is composed of data including coordinate information representing a final intended (surface) shape of a construction target in a construction area. That is, the design data 35 is different from map data that includes previously inputted coordinate information on roads, buildings, and the like (i.e., except the construction target) within the construction area. The design data 35 is represented by a point cloud (e.g., C1, C2, C3 in FIG. 5) including three-dimensional position information in the site coordinate system. The design data 35 may also be represented by surface information S1 including three points (C1, C2, C3). An operator may set and select any point or surface that forms the design data 35.

For example, of the vehicle body coordinates, coordinates of the bucket tip position P4 can be obtained using trigonometric functions from the distance L (FIG. 4) between the vehicle body position P0 and the bucket tip position P4 and the turning angle θsw. The distance L between the vehicle body position P0 and the bucket tip position P4 can be calculated using the aforementioned trigonometric functions using the posture information on the hydraulic excavator 1. The turning angle θsw can be obtained from the information from the turning angle sensor 22, for example.

<Internal Configuration of Controller 25>

Figure 6:
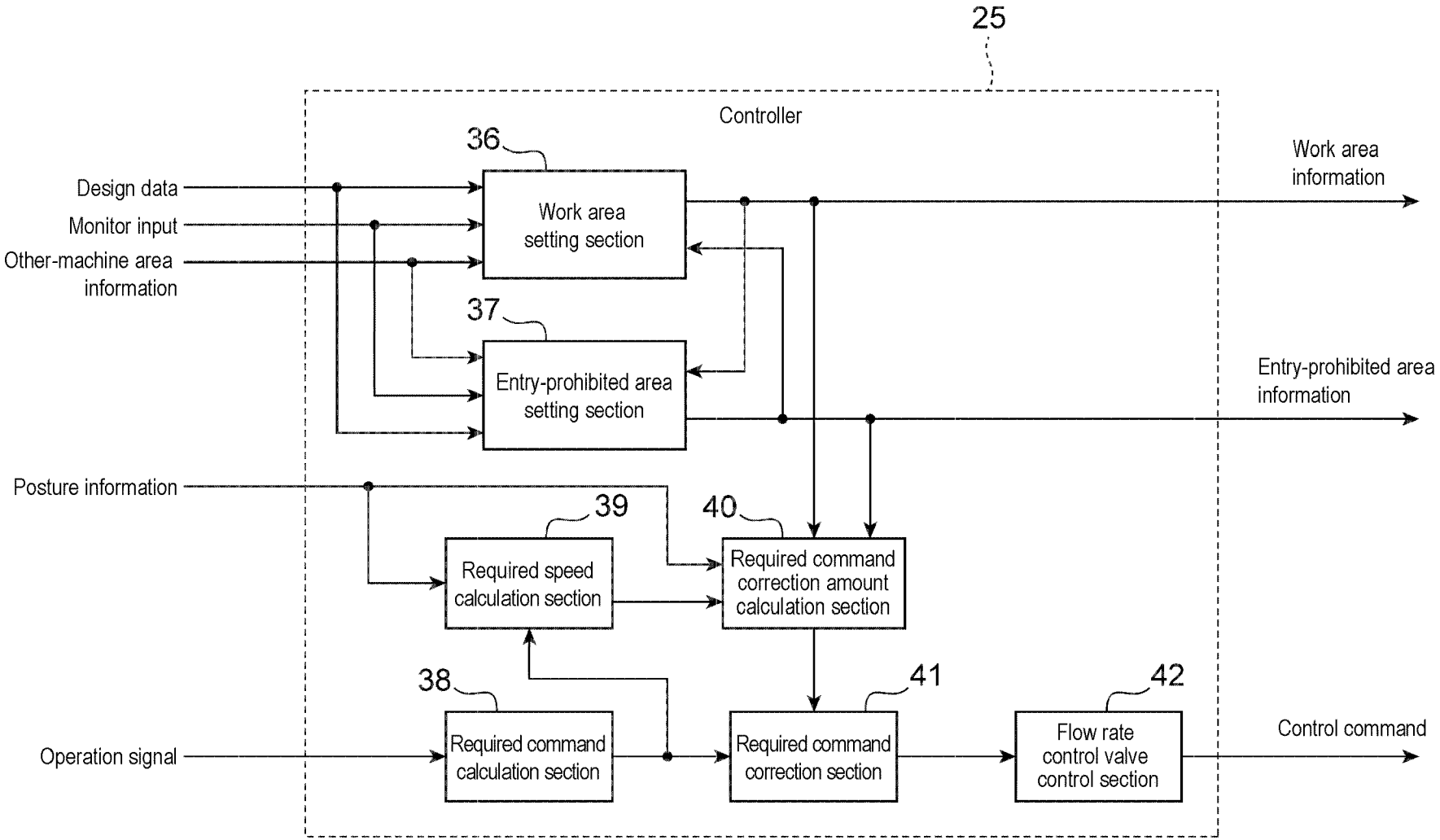
FIG. 6 is a diagram showing an internal configuration of a controller related to area restriction control.

FIG. 6 is a diagram showing an internal configuration of a controller related to area restriction control. The controller 25 includes a work area setting section 36, an entry-prohibited area setting section 37, a required command calculation section 38, a required speed calculation section 39, a required command correction amount calculation section 40, a required command correction section 41, and a flow rate control valve control section 42.

The work area setting section 36 sets a work area of an own machine from the design data 35, a setting input from the monitor 28 (monitor input), other-machine area information (information about a work area and an entry-prohibited area set by other machines) acquired from the communication device 27, and entry-prohibited area information set by the entry-prohibited area setting section 37, and then outputs the set work area of the own machine. The set work area of the own machine is inputted to the entry-prohibited area setting section 37 and the required command correction amount calculation section 40 and transmitted from the communication device 27 to the construction management server or the other work machines (other machines).

The entry-prohibited area setting section 37 sets an entry-prohibited area of the own machine from the design data 35, a setting input from the monitor 28 (monitor input), other-machine area information (information about a work area and an entry-prohibited area set by other machines) acquired from the communication device 27, and the work area information set by the work area setting section 36, and then outputs the set entry-prohibited area of the own machine. The set entry-prohibited area of the own machine is inputted to the work area setting section 36 and the required command correction amount calculation section 40 and transmitted from the communication device 27 to the construction management server or the other work machines (other machines).

The required command calculation section 38 calculates a required command for the flow rate control valve based on an operation signal according to an operation amount outputted from the control lever 29. The calculated required command for the flow rate control valve is inputted to the required speed calculation section 39 and the required command correction section 41.

The required speed calculation section 39 calculates and outputs a target speed in the site coordinates on each control point based on the required command for the flow rate control valve outputted from the required command calculation section 38 and the posture information acquired from the posture sensor 26.

The required command correction amount calculation section 40 calculates and outputs a required command correction amount, that is, the degree of correction of the required command for the flow rate control valve, based on the work area information outputted from the work area setting section 36, the entry-prohibited area information outputted from the entry-prohibited area setting section 37, the posture information acquired from the posture sensor 26, and the target speed on each control point outputted from the required speed calculation section 39.

The required command correction section 41 outputs a corrected required command for the flow rate control valve from the required command correction amount outputted from the required command correction amount calculation section 40 and the required command outputted from the required command calculation section 38.

The flow rate control valve control section 42 calculates and outputs a control command for each flow rate control valve based on the corrected required command outputted from the required command correction section 41.

(Setting of Work Area of Own Machine by Work Area Setting Section 36)

With reference to FIG. 7 to FIG. 15, setting a work area of an own machine by the work area setting section 36 will be described. First, with reference to FIG. 7 to FIG. 14, setting a work area other than in the direction of gravity in the construction area (work area) or the vertical direction of the vehicle body will be described, and then with reference to FIG. 15, setting a work area in the direction of gravity in the construction area (work area) or the vertical direction of the vehicle body will generally be described.

Figure 22:
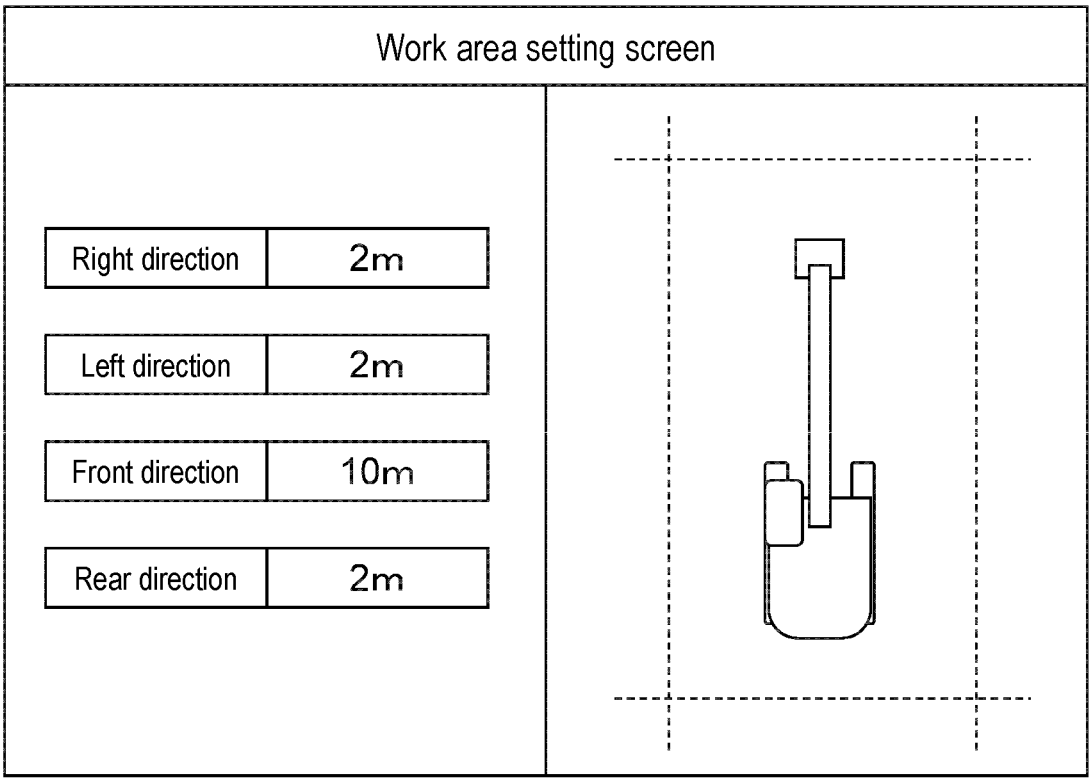
FIG. 22 is a monitor screen when a work area is set based on the position of a vehicle body.

In the description below, in setting a work area other than in the direction of gravity in the construction area (work area) or the vertical direction of the vehicle body, the work area setting mode is switched by the operation of the switch 47 and the work area setting mode for setting a work area based on the design data is executed. It should be noted that description will be given later as for the case where the work area setting mode is switched by the operation of the switch 47 and the work area setting mode for setting a work area based on the position of the vehicle body is executed (FIG. 22).

Figure 7:
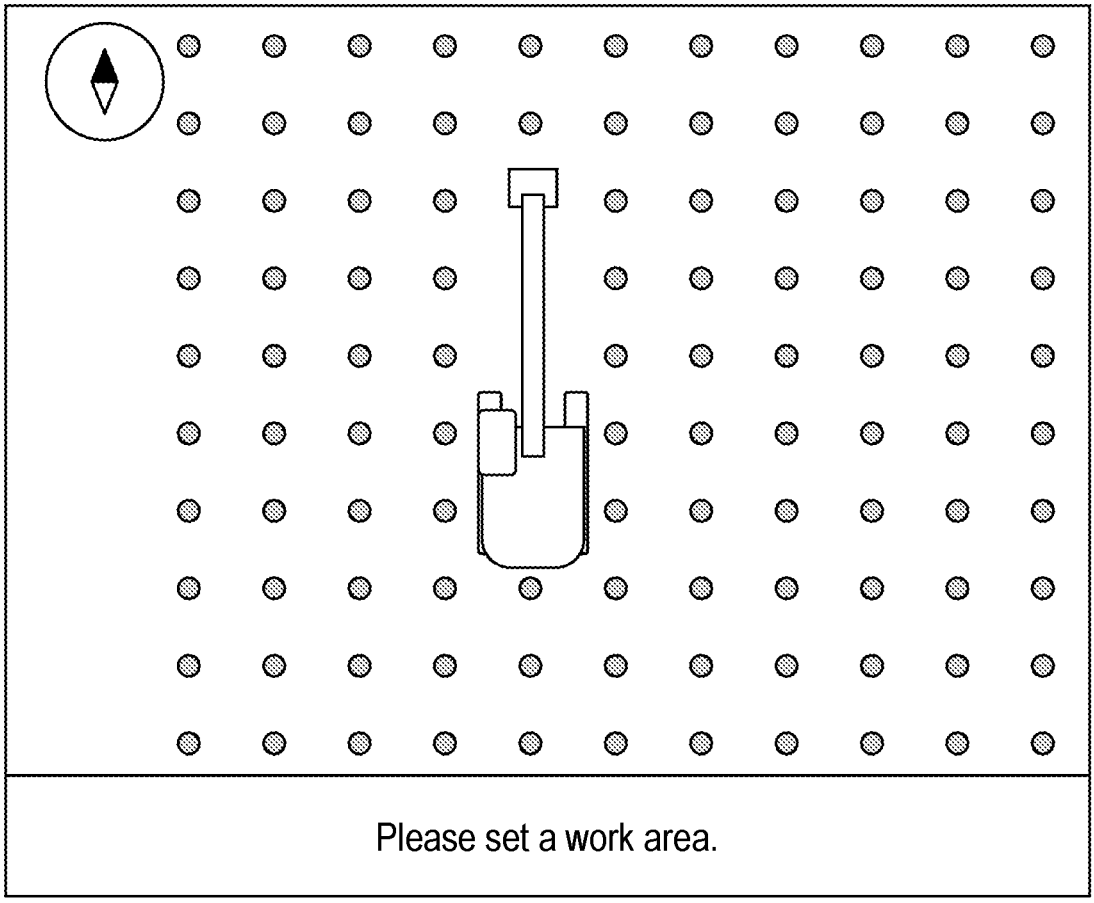
FIG. 7 is a monitor screen for setting a work area from point cloud information in the design data.

FIG. 7 is a monitor screen for setting a work area from point cloud information in the design data. In the example shown in FIG. 7, the design data is composed of a point cloud of coordinate points (see in conjunction with FIG. 5), and on the monitor screen (the display screen of the monitor 28) during work area setting, a hydraulic excavator, a compass indicating orientations, and point cloud information in the design data are displayed. A work area is set by an operator selecting from the point cloud information a point cloud (a plurality of points) intended to be set as a work area and creating a closed area. That is, herein, the work area setting section 36 sets a work area of the own machine from the setting input from the monitor 28 (monitor input) (the same also applies to FIG. 8 and FIG. 9 below). Control is performed on the work area set on the monitor screen so as to restrict operation of the vehicle body in the x and y directions (i.e., directions other than in the direction of gravity in the construction area or the vertical direction of the vehicle body) in the site coordinate system.

Figure 8:
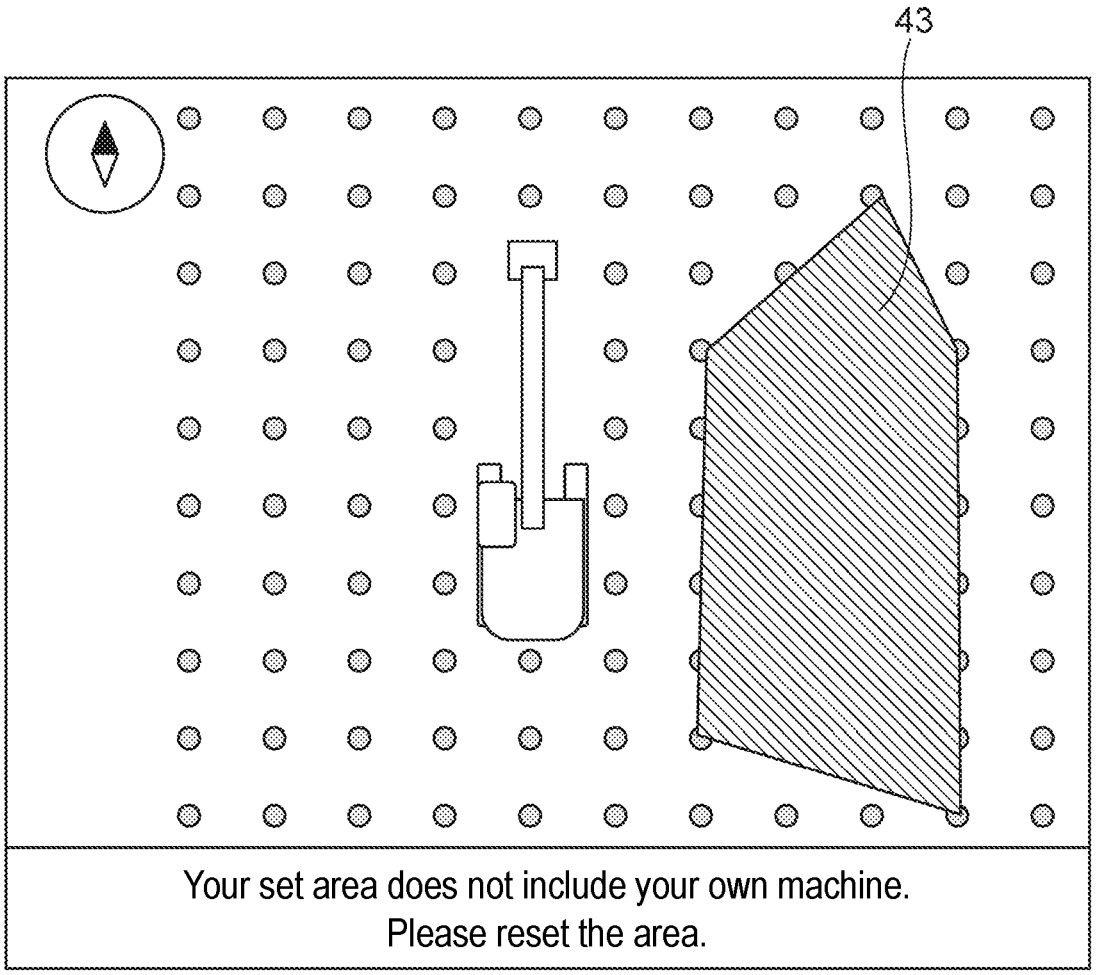
FIG. 8 is a monitor screen when a work area is set from point cloud information in the design data such that an own machine is not included.

FIG. 8 is a monitor screen when a work area is set from point cloud information in the design data such that an own machine is not included. As shown in FIG. 8, on the work area setting screen, when the operator sets a work area (closed area) 43 so as not to include its own hydraulic excavator, a display command is outputted from the work area setting section 36 to the monitor 28, and a warning to prompt the operator to reset the work area is displayed on the monitor screen. In this way, prohibiting setting a work area not including the own machine can prevent unnecessary restriction of the operation of the hydraulic excavator.

Figure 9:
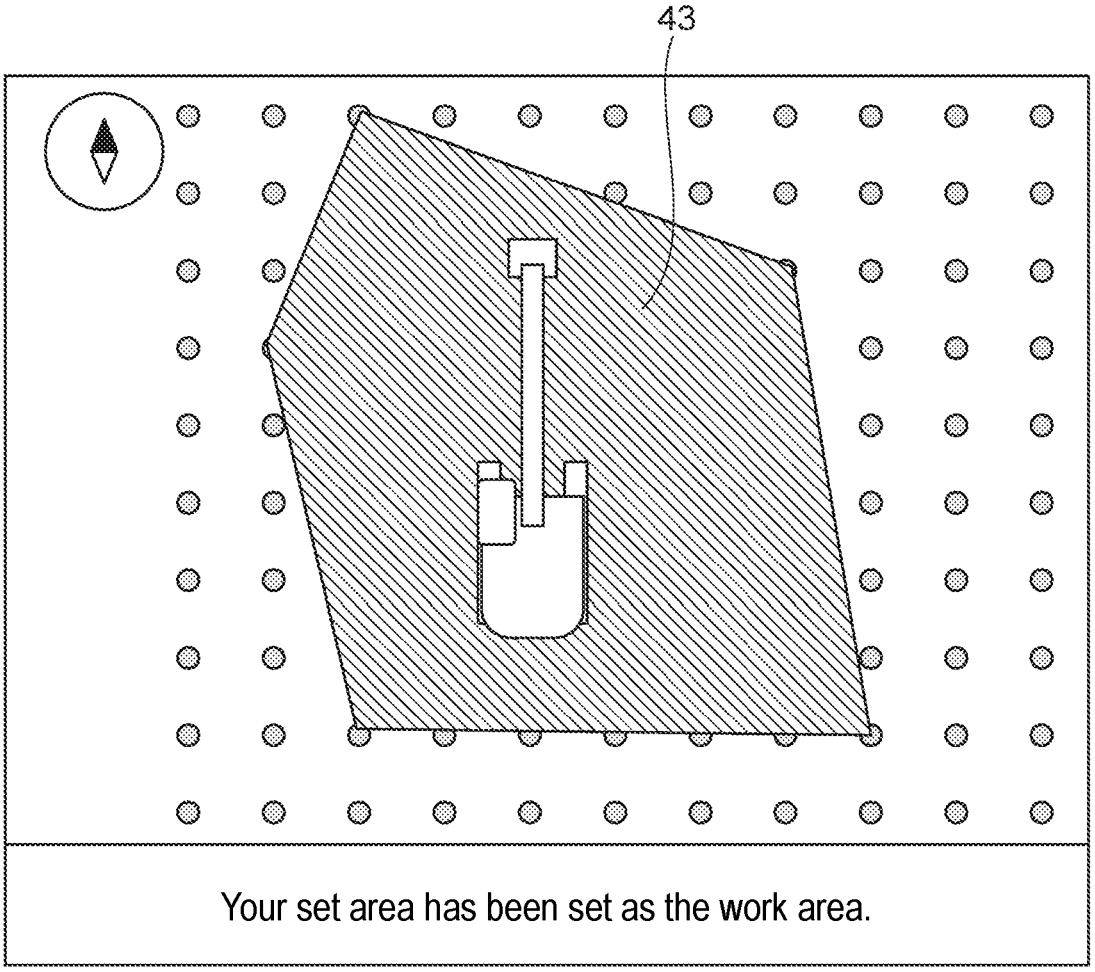
FIG. 9 is a monitor screen when a work area is set from point cloud information in the design data such that an own machine is included.

FIG. 9 is a monitor screen when a work area is set from point cloud information in the design data such that an own machine is included. As shown in FIG. 9, on the work area setting screen, when the operator sets a work area (closed area) 43 so as to include its own hydraulic excavator, a display command is outputted from the work area setting section 36 to the monitor 28, and on the monitor screen, the work area 43 set by the operator is displayed and text to notify the normal completion of the setting is displayed.

That is, in this example, the closed area formed by the point cloud (the plurality of points) selected from the point cloud information is set as a work area only when the current position of the hydraulic excavator is included.

Figure 10:
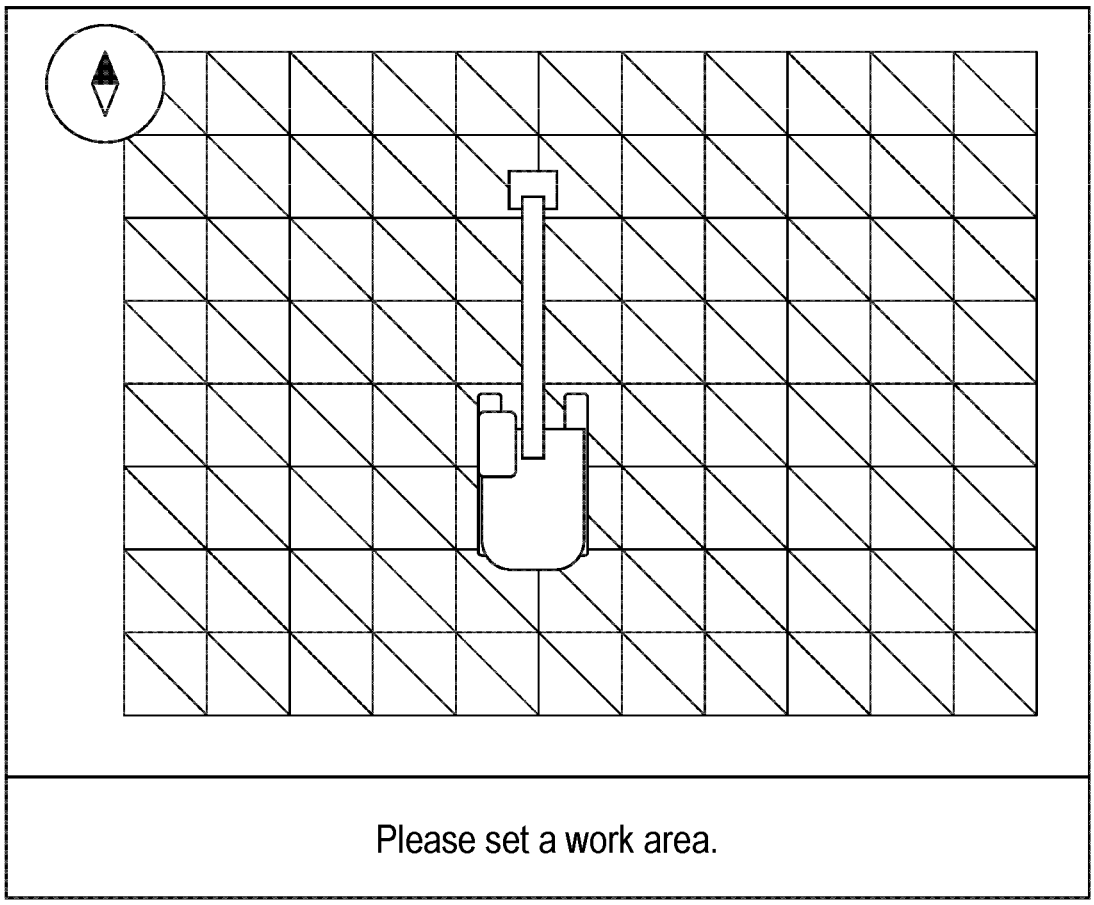
FIG. 10 is a monitor screen for setting a work area from surface group information in the design data (design surface data).

FIG. 10 is a monitor screen for setting a work area from surface group information in the design data (design surface data). In the example shown in FIG. 10, the design data 35 is composed of a surface group (a plurality of surfaces) including coordinate information (see in junction with FIG. 5), and on the monitor screen (the display screen of the monitor 28) during work area setting, a hydraulic excavator, a compass indicating orientations, and surface group information representing the design data are displayed. A work area can be set by an operator selecting from the surface group information one or more surfaces intended to be set as a work area. That is, herein, the work area setting section 36 sets a work area of the own machine from the setting input from the monitor 28 (monitor input) (the same also applies to FIG. 11 and FIG. 12 below).

Figure 11:
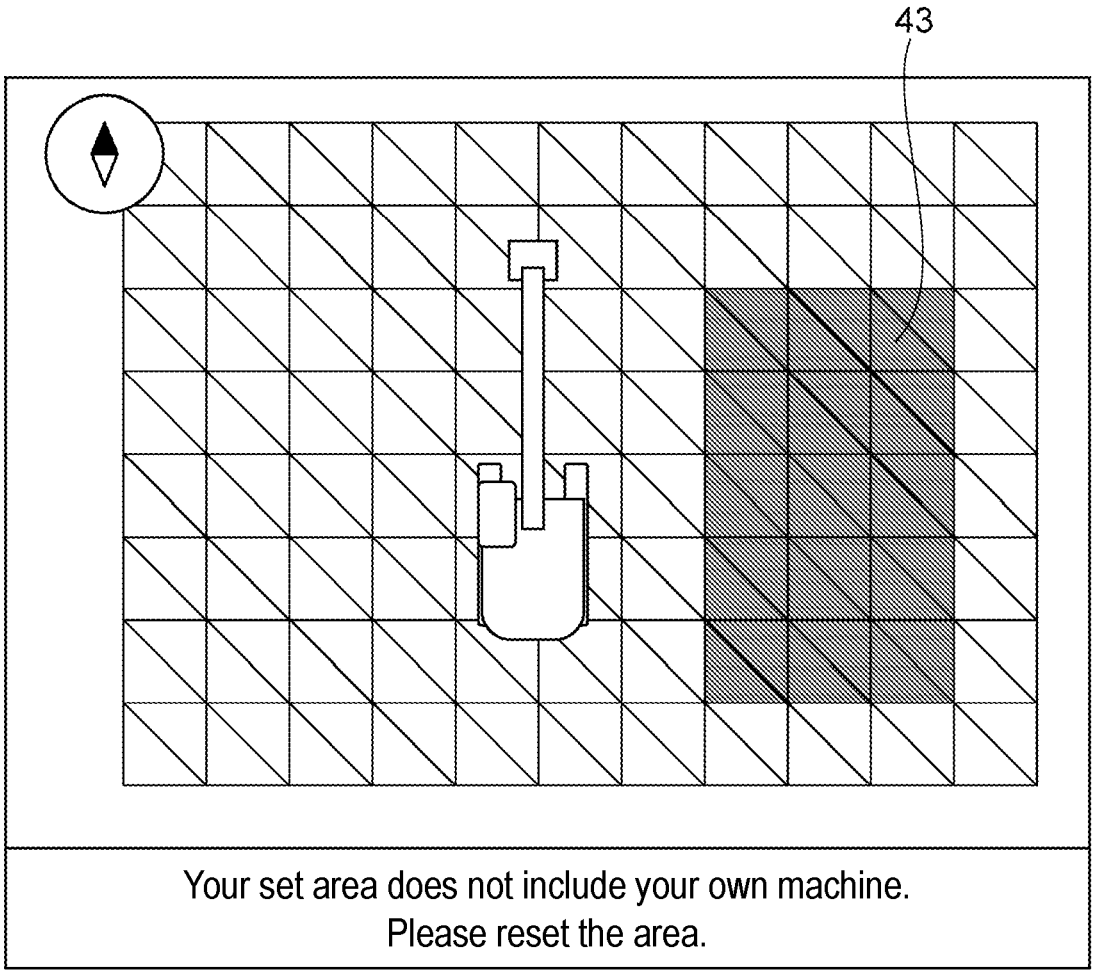
FIG. 11 is a monitor screen when a work area is set from surface group information in the design data (design surface data) such that an own machine is not included.

FIG. 11 is a monitor screen when a work area is set from surface group information in the design data (design surface data) such that an own machine is not included. As shown in FIG. 11, on the work area setting screen, when the operator sets a work area (surface) 43 so as not to include its own hydraulic excavator, a display command is outputted from the work area setting section 36 to the monitor 28, and a warning to prompt the operator to reset the work area is displayed on the monitor screen. In this way, prohibiting setting a work area not including the own machine can prevent unnecessary restriction of the operation of the hydraulic excavator.

Figure 12:
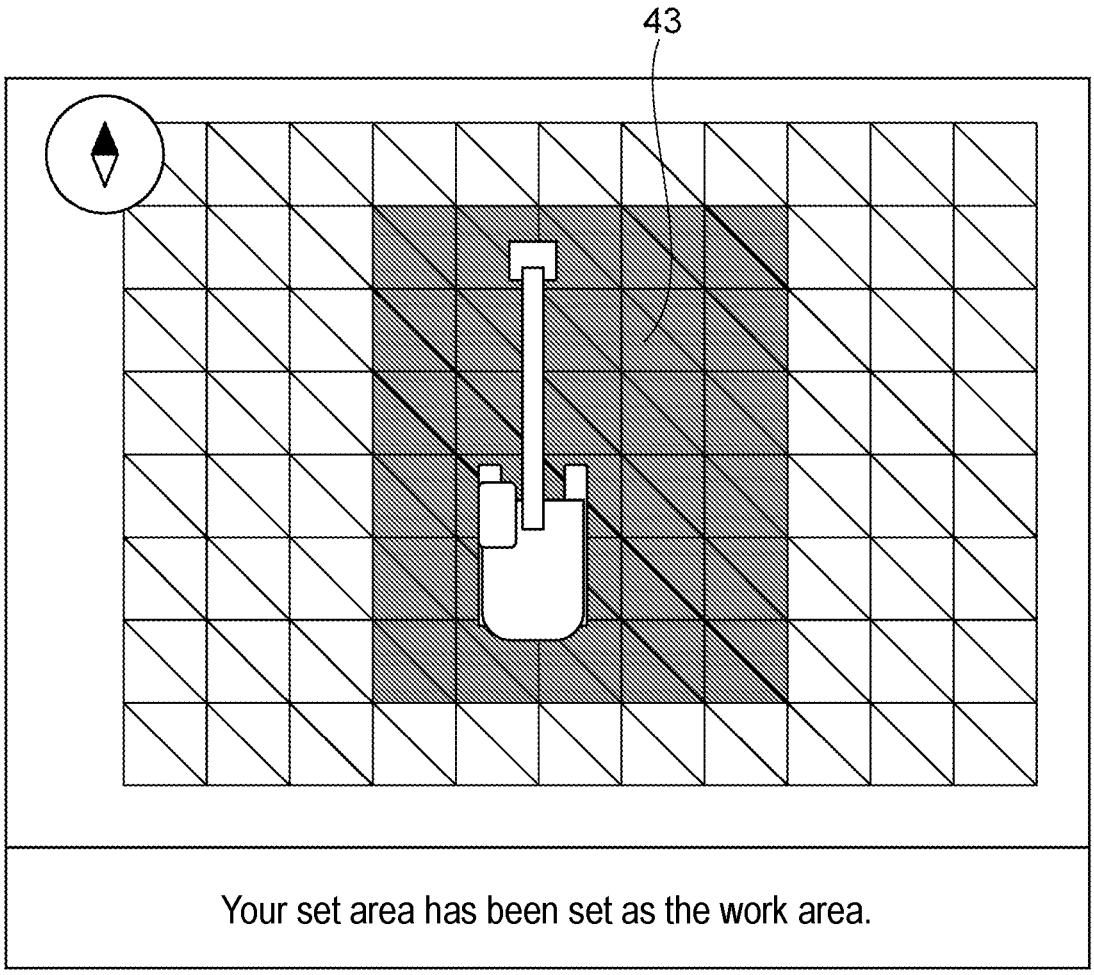
FIG. 12 is a monitor screen when a work area is set from surface group information in the design data (design surface data) such that an own machine is included.

FIG. 12 is a monitor screen when a work area is set from surface group information in the design data (design surface data) such that an own machine is included. As shown in FIG. 12, on the work area setting screen, when the operator sets a work area (surface) 43 so as to include its own hydraulic excavator, a display command is outputted from the work area setting section 36 to the monitor 28, and on the monitor screen, the work area 43 set by the operator is displayed and text to notify the normal completion of the setting is displayed.

In addition, as shown in FIG. 10 to FIG. 12, when a work area is set from the surface group information in the design data (design surface data), by setting in advance, as a work area, the design surface data located in the direction of gravity of the coordinates of the own machine (that is, the design surface data below the current position of the work machine), it is possible to prevent the operator from setting a work area not including the own machine.

Figure 13:
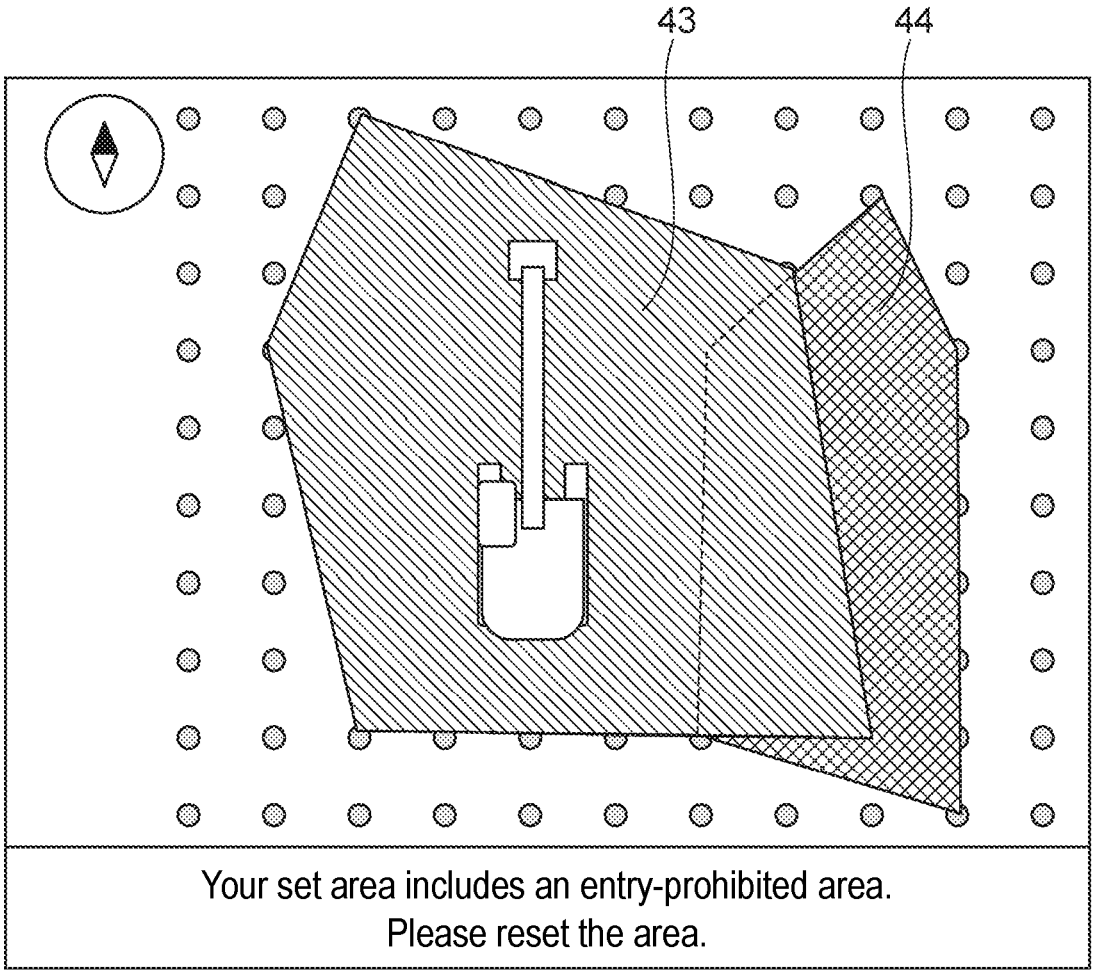
FIG. 13 is a monitor screen when a work area is set on an entry-prohibited area.

FIG. 13 is a monitor screen when a work area is set on an entry-prohibited area. As shown in FIG. 13, on the work area setting screen, when the operator sets a work area 43 so as to include an entry-prohibited area 44 (or at least a part thereof) that has already been set in the entry-prohibited area setting section 37, a display command is outputted from the work area setting section 36 to the monitor 28, and on the monitor screen, text to notify that the work area includes the entry-prohibited area and text to prompt the operator to reset the work area are displayed. That is, herein, the work area setting section 36 sets a work area of the own machine from the setting input from the monitor 28 (monitor input) and the entry-prohibited area information set by the entry-prohibited area setting section 37. In this way, prohibiting setting, as a work area, the entry-prohibited area that has already been set can prevent the operator from setting, as a work area, the area that has already been set as the entry-prohibited area, and can avoid entry of the work machine.

Figure 14:
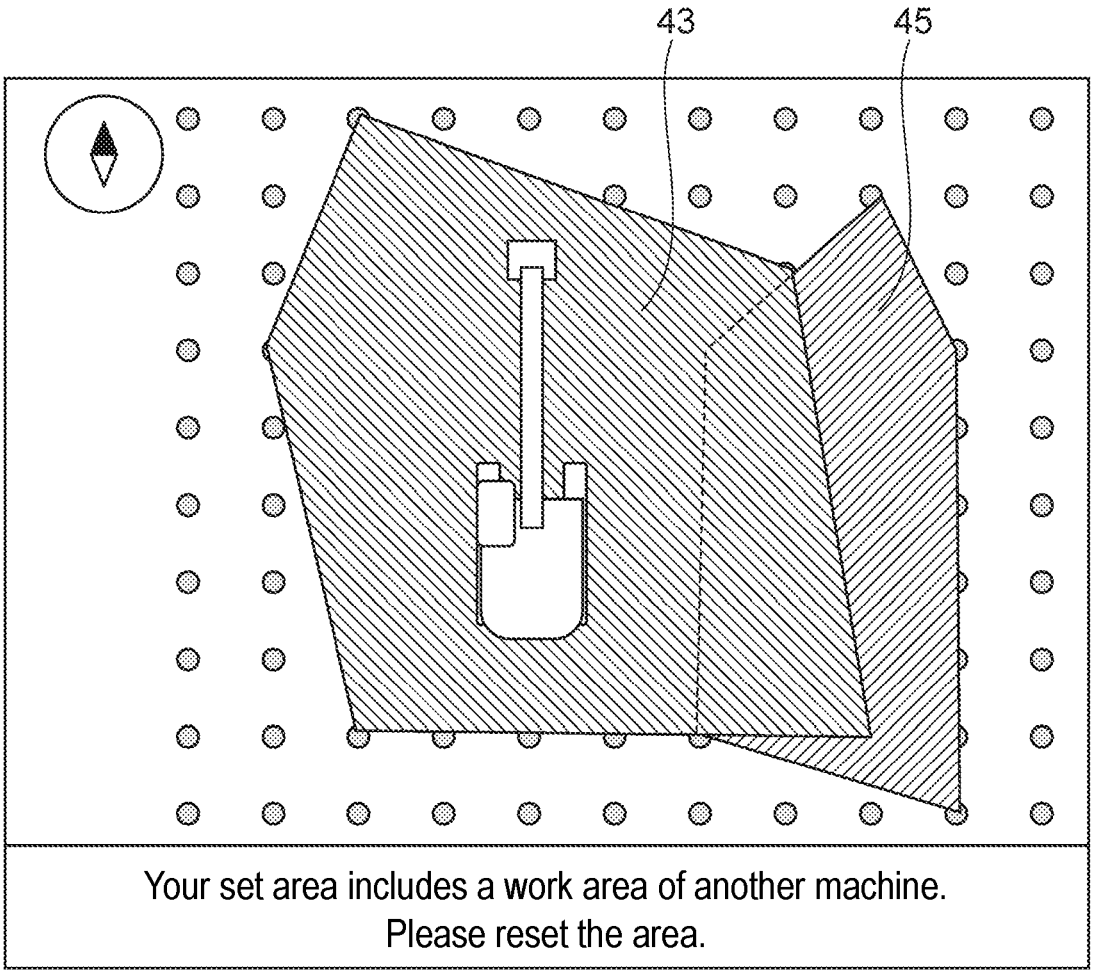
FIG. 14 is a monitor screen when a work area of an own machine is set on a work area of another machine.

FIG. 14 is a monitor screen when a work area of an own machine is set on a work area of another machine. As shown in FIG. 14, on the work area setting screen, when the operator sets a work area 43 of the own vehicle so as to include a work area 45 (or at least a part thereof) of another machine, a display command is outputted from the work area setting section 36 to the monitor 28, and on the monitor screen, text to notify that the work area of the own machine is set so as to include the work area of another machine and text to prompt the operator to reset the work area are displayed. That is, herein, the work area setting section 36 sets a work area of the own machine from the setting input from the monitor 28 (monitor input) and the other-machine area information acquired from the communication device 27. In this way, prohibiting setting, as a work area of the own machine, the work area that has already been set by the other machines can prevent collision of the work machines having area restriction control on a site where a plurality of work machines operate.

Figure 15:
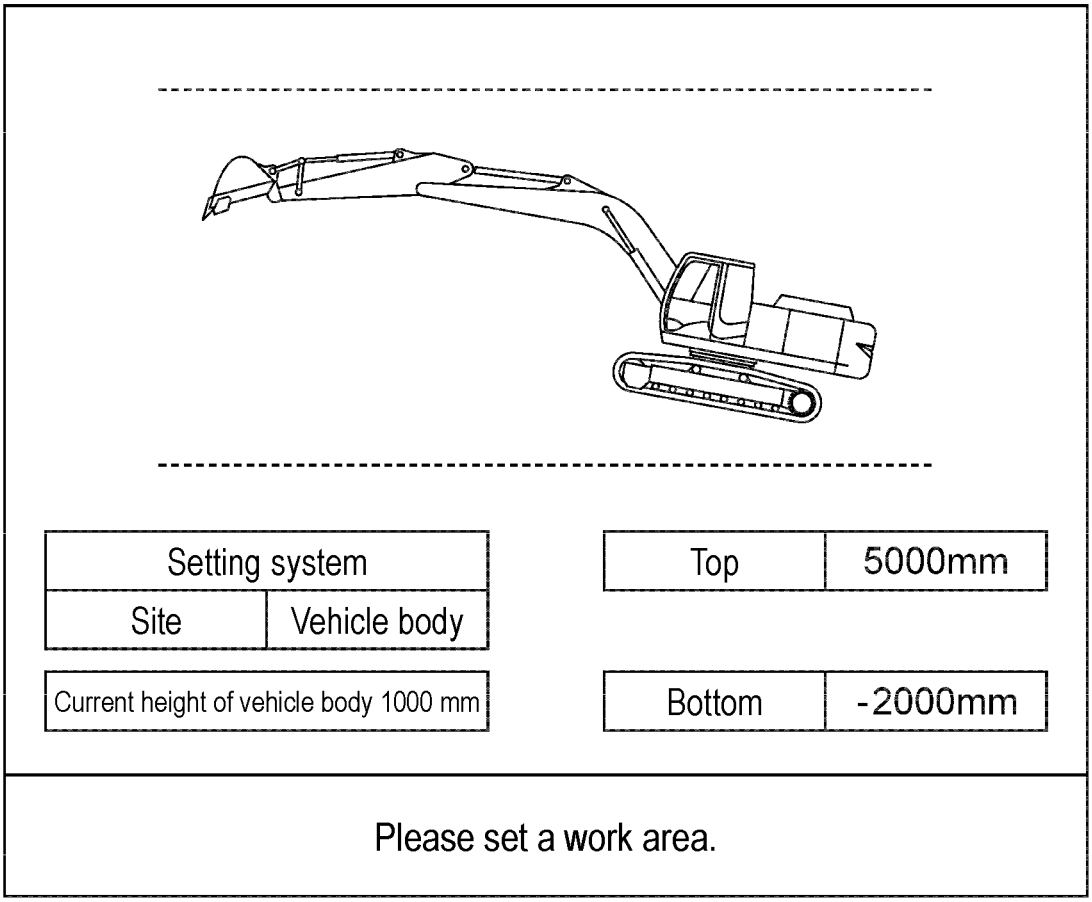
FIG. 15 is a monitor screen when a work area is set in a height direction and a depth direction.

FIG. 15 is a monitor screen when a work area is set in a height direction and a depth direction. From the above-described design data, the area in the x direction and the y direction in the site coordinate system (i.e., the area other than in the direction of gravity in the construction area (work area) or the vertical direction of the vehicle body) is set. Meanwhile, the area in the z direction in the site coordinate system (i.e., the area in the direction of gravity in the construction area (work area) or the vertical direction of the vehicle body) is set on a different setting screen on the monitor 28.

The monitor screen during work area setting shows a current posture of the vehicle body, a switch for selection of the reference coordinate system when setting area restriction in the height direction from the site coordinate system or the turning body coordinate system, a current height of the vehicle body in the site coordinate system, and input items for limit values in the height direction and the depth direction. When the traveling operation is not performed, a height may be inputted to the turning body coordinate system, or when a depth of the underground object is known from the map data or the like, depth information may be set in the site coordinate system. A work area is set by the operator selecting and inputting the item(s) intended to be set as a work area.

That is, in the present embodiment, for the area in the x direction and the y direction in the site coordinate system, a work area is set from the design data, and for the area in the z direction in the site coordinate system, a work area is set based on the site or based on the vehicle body.

(Setting of Entry-Prohibited Area of Own Machine by Entry-Prohibited Area Setting Section 37)

With reference to FIG. 16 to FIG. 19, setting an entry-prohibited area (an area for which entry of the vehicle body is avoided) of an own machine by the entry-prohibited area setting section 37 will be described. Herein, in setting an entry-prohibited area other than in the direction of gravity in the construction area (work area) or the vertical direction of the vehicle body, an entry-prohibited area is set based on the above-described design data 35. Although the following describes setting an entry-prohibited area from point cloud information in the design data, it is needless to mention that the same also applies to the case of setting an entry-prohibited area from surface group information in the design data (design surface data) (see in conjunction with FIG. 10 to FIG. 12).

Figure 16:
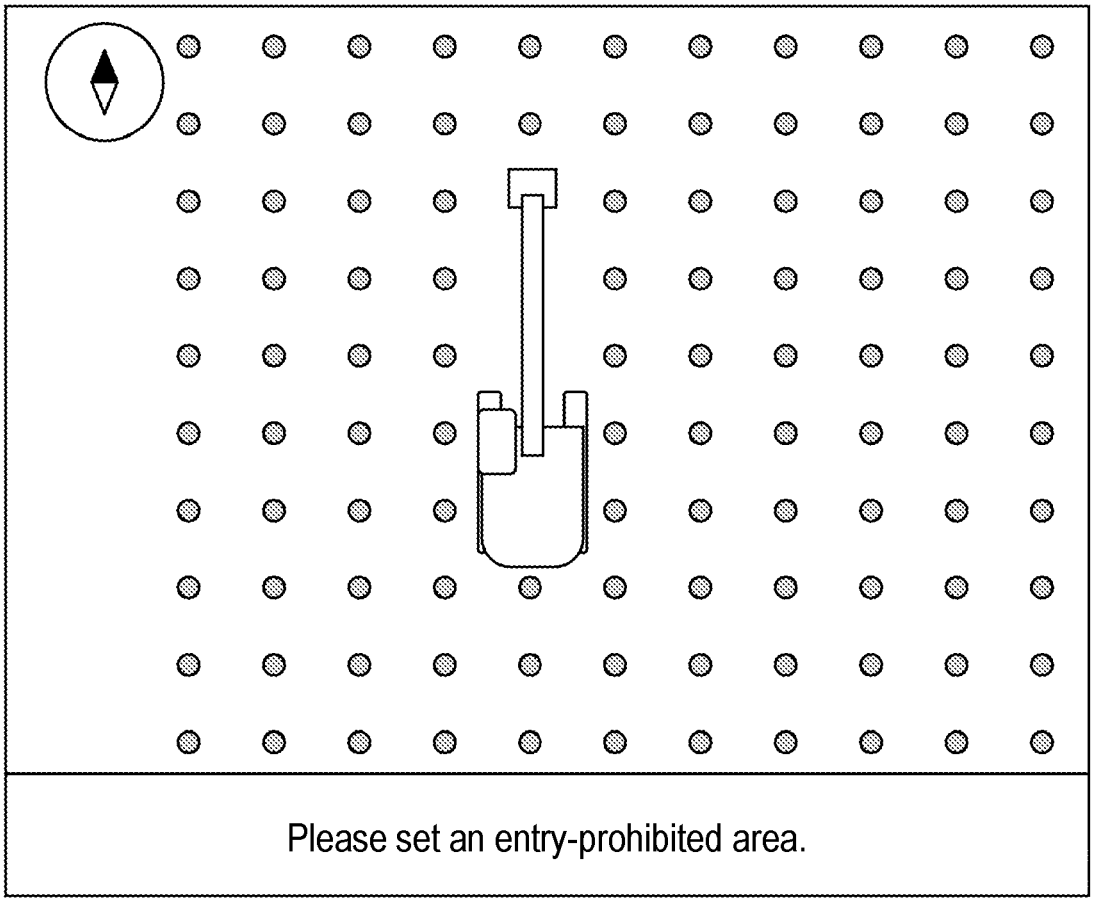
FIG. 16 is a monitor screen for setting an entry-prohibited area from point cloud information in the design data.

FIG. 16 is a monitor screen for setting an entry-prohibited area from point cloud information in the design data. In the example shown in FIG. 16, the design data 35 is composed of a point cloud of coordinate points (see in conjunction with FIG. 5), and on the monitor screen (the display screen of the monitor 28) during entry-prohibited area setting, a hydraulic excavator, a compass indicating orientations, point cloud information in the design data are displayed. An entry-prohibited area is set by an operator selecting from the point cloud information a point cloud (a plurality of points) intended to be set as an entry-prohibited area and creating a closed area. That is, herein, the entry-prohibited area setting section 37 sets an entry-prohibited area of the own machine from the setting input from the monitor 28 (monitor input) (the same also applies to FIG. 17 and FIG. 18 below). Control is performed on the entry-prohibited area set on the monitor screen so as to restrict operation of the vehicle body in the x and y directions (i.e., directions other than in the direction of gravity in the construction area or the vertical direction of the vehicle body) in the site coordinate system.

Figure 17:
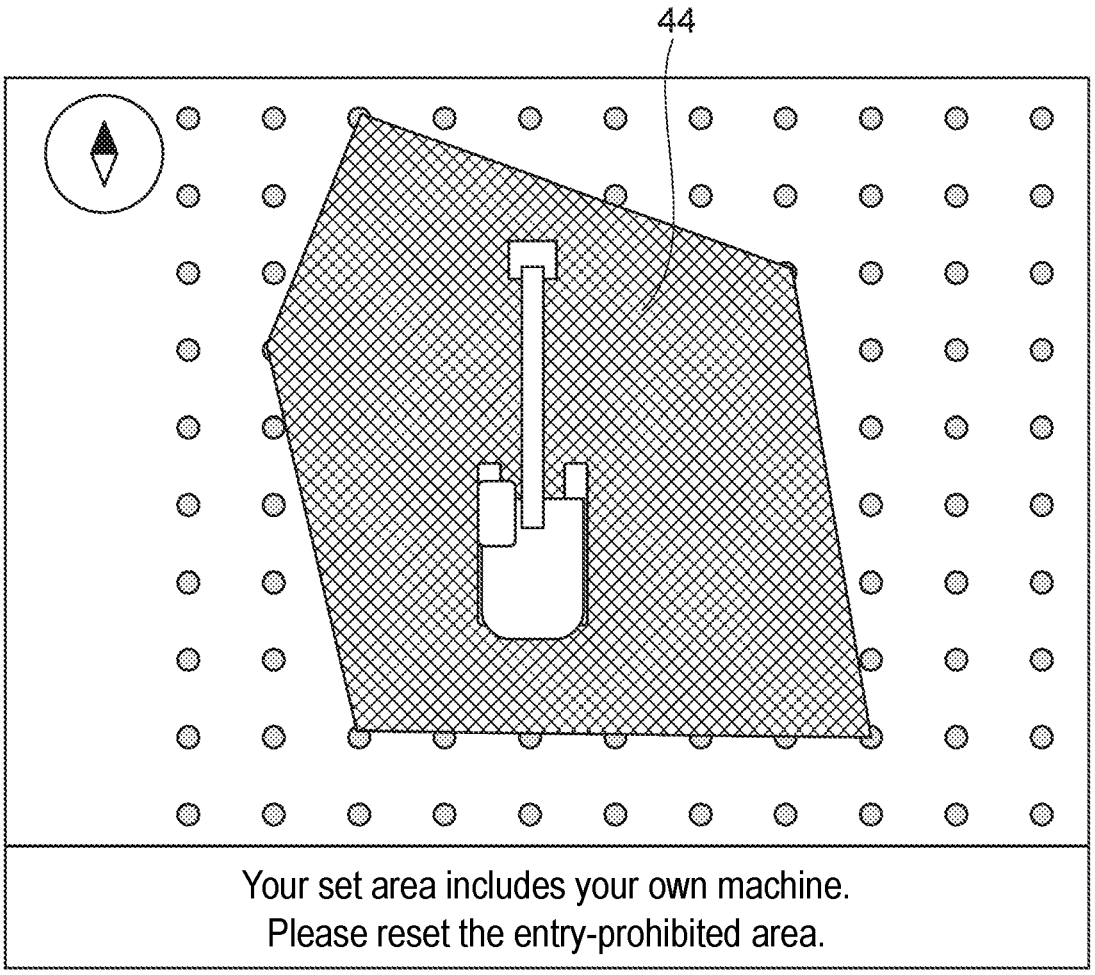
FIG. 17 is a monitor screen when an entry-prohibited area is set from point cloud information in the design data such that an own machine is included.

FIG. 17 is a monitor screen when an entry-prohibited area is set from point cloud information in the design data such that an own machine is included. As shown in FIG. 17, on the entry-prohibited area setting screen, when the operator sets an entry-prohibited area (closed area) 44 so as to include position information on the own machine, a display command is outputted from the entry-prohibited area setting section 37 to the monitor 28, and on the monitor screen, text to notify the operator of the need to reset the entry-prohibited area is displayed. In this way, prohibiting setting an entry-prohibited area including the own machine can prevent unnecessary restriction of the operation of the hydraulic excavator.

Figure 18:
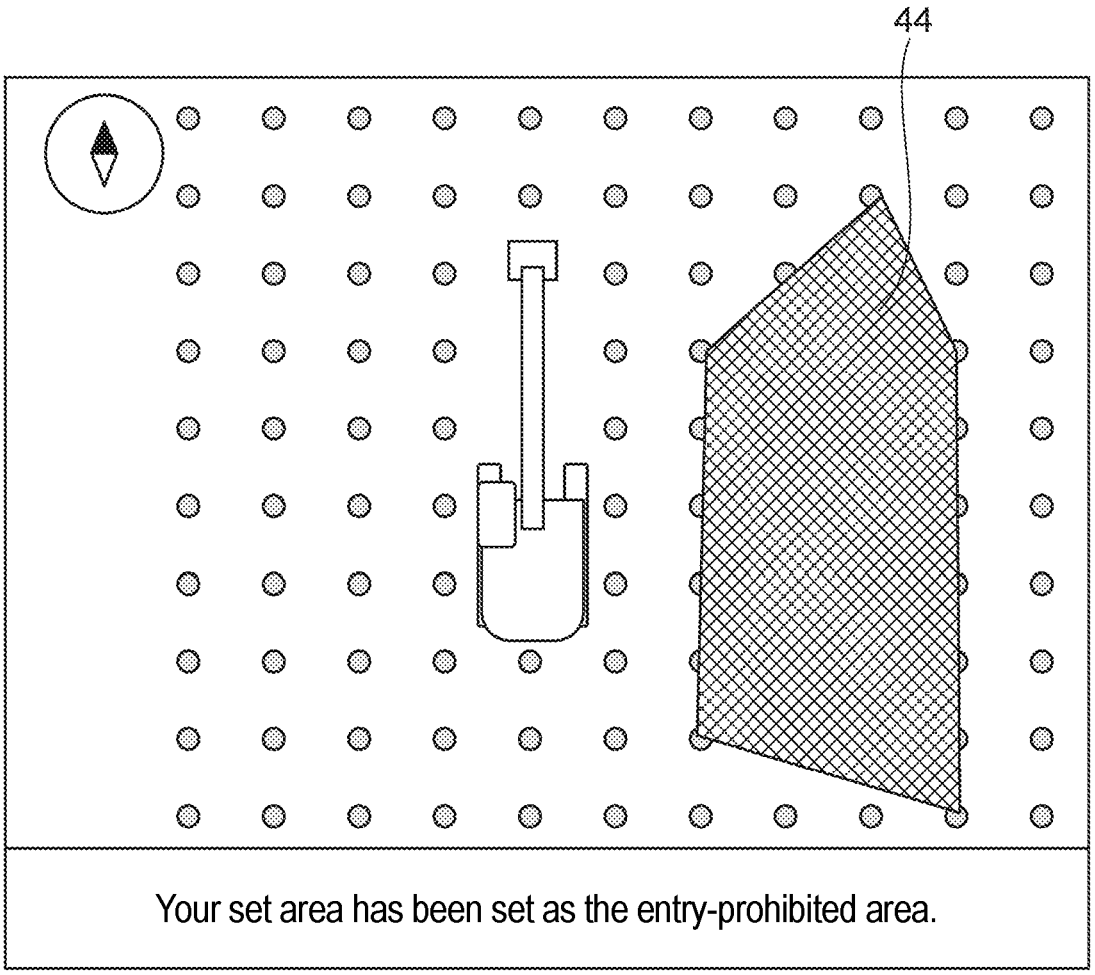
FIG. 18 is a monitor screen when an entry-prohibited area is set from point cloud information in the design data such that an own machine is not included.

FIG. 18 is a monitor screen when an entry-prohibited area is set from point cloud information in the design data such that an own machine is not included. As shown in FIG. 18, on the entry-prohibited area setting screen, when the operator sets an entry-prohibited area (closed area) 44 so as not to include position information on the own machine, a display command is outputted from the entry-prohibited area setting section 37 to the monitor 28, and on the monitor screen, the entry-prohibited area 44 set by the operator is displayed and text to notify the normal completion of the setting is displayed.

That is, in this example, the closed area formed by the point cloud (the plurality of points) selected from the point cloud information is set as an entry-prohibited area only when the current position of the hydraulic excavator is not included.

Though not shown in the drawings, when an entry-prohibited area is set from the surface group information in the design data (design surface data), it may be possible to prohibit setting in advance, as an entry-prohibited area, the design surface data located in the direction of gravity of the coordinates of the own machine (that is, the design surface data below the current position of the work machine).

Figure 19:
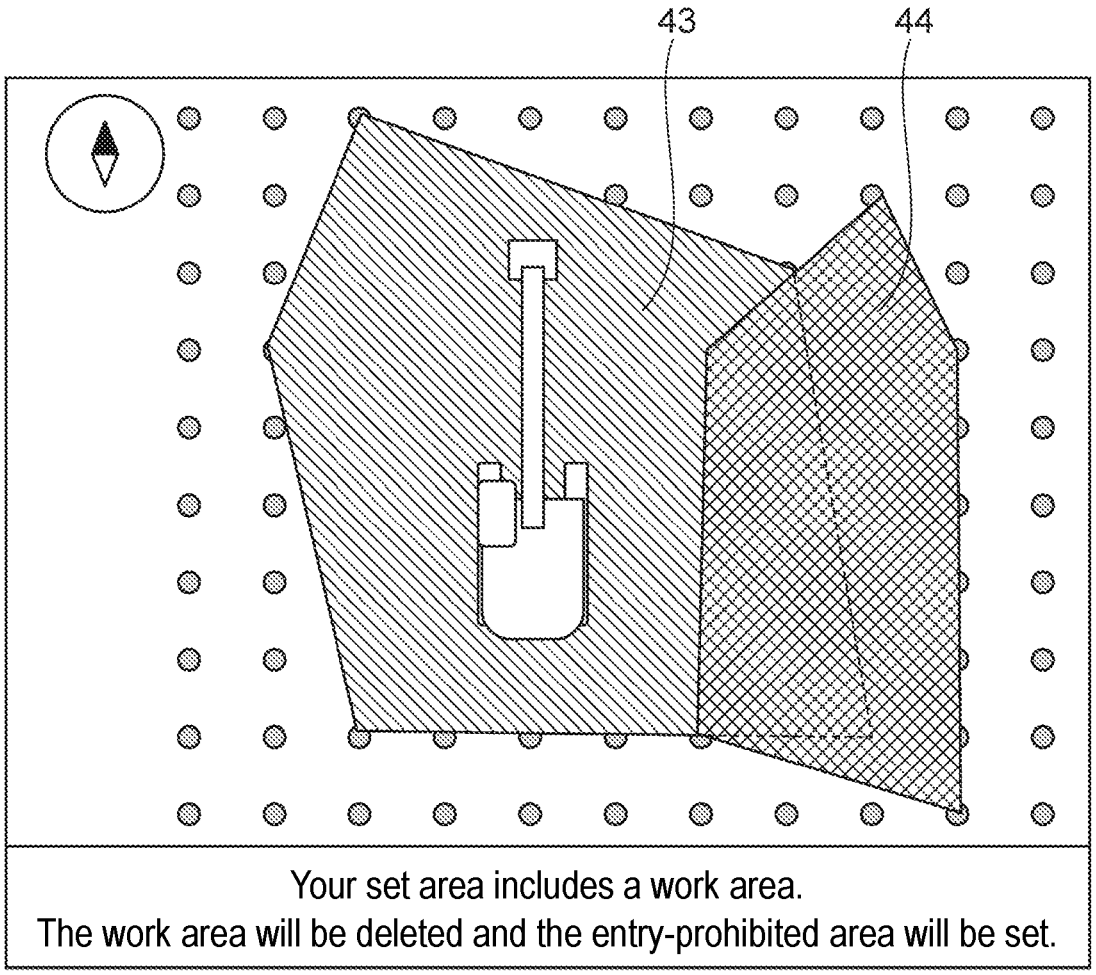
FIG. 19 is a monitor screen when an entry-prohibited area is set on a work area.

FIG. 19 is a monitor screen when an entry-prohibited area is set on a work area. As shown in FIG. 19, on the entry-prohibited area setting screen, when the operator sets an entry-prohibited area 44 so as to include a work area 43 (or a part thereof) that has already been set in the work area setting section 36, the work area is deleted and the entry-prohibited area is set, and also a display command is outputted from the entry-prohibited area setting section 37 to the monitor 28, and on the monitor screen, text to notify to that effect is displayed. That is, herein, the entry-prohibited area setting section 37 sets an entry-prohibited area of the own machine from the setting input from the monitor 28 (monitor input) and the work area information set by the work area setting section 36. In this way, when the work area set in advance is set as the entry-prohibited area, the existing work area is overwritten with the entry-prohibited area. This allows setting an entry-prohibited area, such as roads, with a higher priority, and avoiding an incorrect setting that may cause entry into the area for which entry is not intended. In addition, when an entry-prohibited area is set so as to include the work area that has already been set, only the overlapping part of the area may be overwritten with the entry-prohibited area and the remaining part of the work area may be maintained as it is.

<Area Restriction Control Performed by Controller 25>

Figure 20:
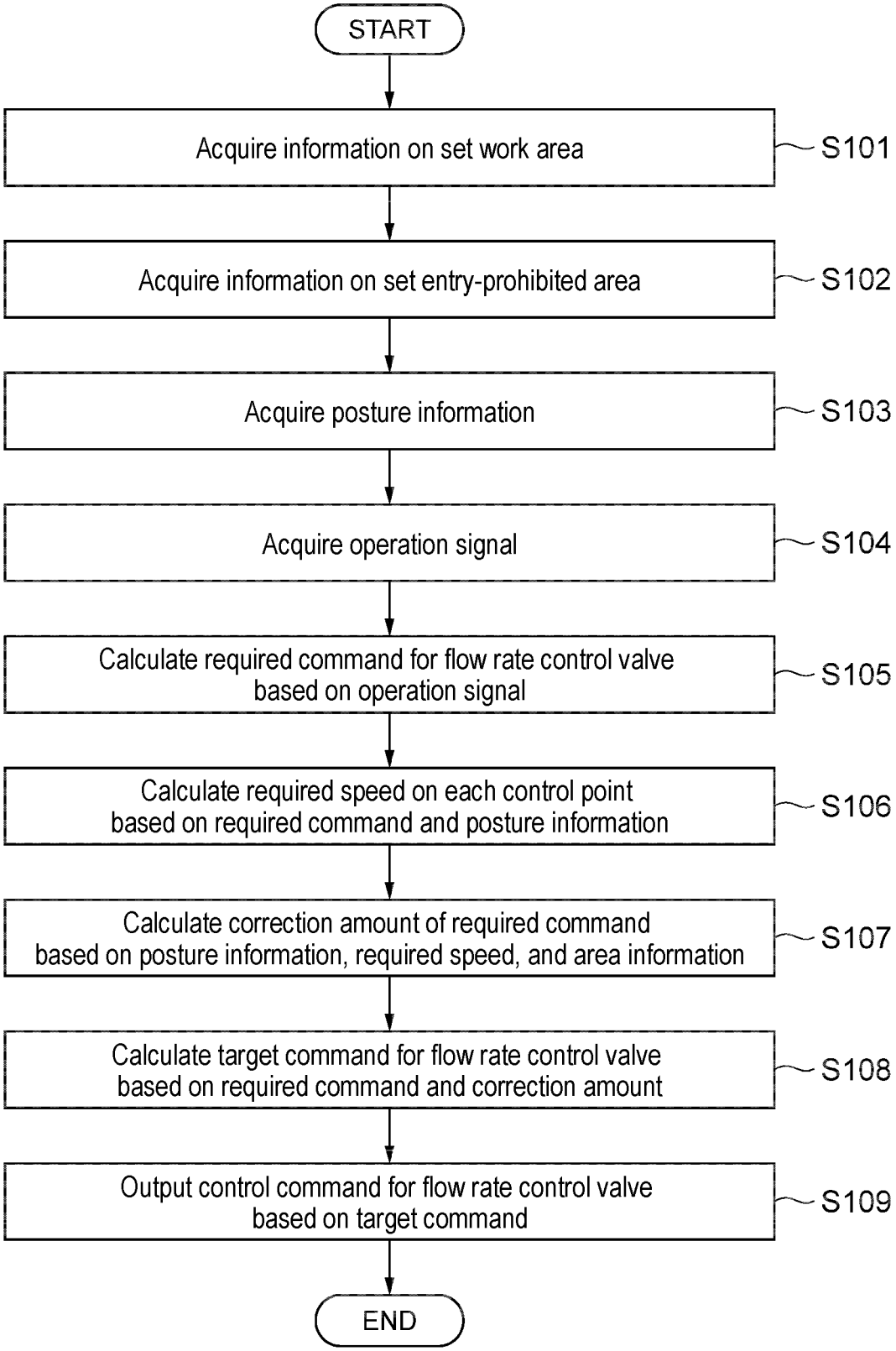
FIG. 20 is a flowchart showing a control flow related to area restriction control performed by a controller.

FIG. 20 is a flowchart showing a control flow related to area restriction control performed by the controller 25.

In the area restriction control performed by the controller 25, in step S101, information on the set work area is acquired (the work area setting section 36, see FIG. 7 to FIG. 15). Next, in step S102, information on the set entry-prohibited area is acquired (the entry-prohibited area setting section 37, see FIG. 16 to FIG. 19).

Next, in step S103, posture information is acquired from the posture sensor 26 (the required speed calculation section 39, the required command correction amount calculation section 40). Next, in step S104, an operation signal according to an operation amount is acquired from the control lever 29 (the required command calculation section 38).

Next, in step S105, a required command for the flow rate control valve is calculated based on the acquired operation signal (the required command calculation section 38).

Next, in step S106, a required speed (target speed) on each control point is calculated based on the required command for the flow rate control valve and the posture information (the required speed calculation section 39).

Next, in step S107, a correction amount of the required command for the flow rate control valve (required command correction amount) is calculated based on the posture information, the required speed on each control point, and the area information representing the work area and entry-prohibited area (the required command correction amount calculation section 40).

Figure 21:
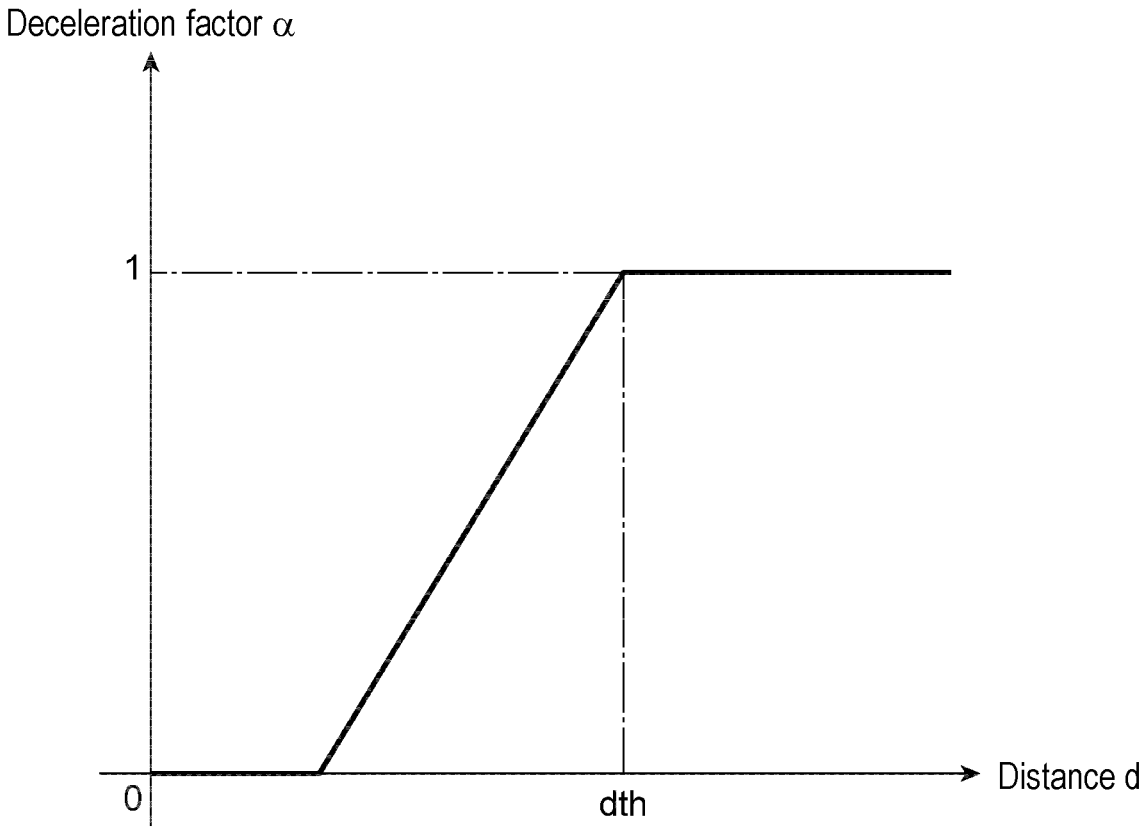
FIG. 21 is a graph showing a relation between a distance and a deceleration factor in the area restriction control.

Specifically, coordinates on each control point in the site coordinate system are calculated based on the posture information, and a distance between each control point and a surface set as a work area is calculated. According to the distance between the control point and the surface set as a work area, a deceleration factor indicating the degree of deceleration of a control command for the flow rate control valve is calculated as a correction amount. FIG. 21 is a graph showing a relation between a distance between the control point and the surface set as a work area and a deceleration factor. The deceleration factor $\alpha$ is 1 when the distance d is large to some extent, and the deceleration factor $\alpha$ decreases as the distance d gets smaller than a predetermined distance dth, and then becomes 0 at around a distance d of 0. The relation between the distance d and the deceleration factor $\alpha$ is a graph for determining the degree of clearance from the work area in stopping the work machine, and the deceleration factor $\alpha$ may be set to just 0 when the distance d is 0.

In step S107, when the target speed on each control point is along a direction coming closer to a surface, the deceleration factor according to the distance is outputted as a correction amount, whereas when the target speed on each control point is along a direction away from a surface, the deceleration factor is outputted as 1. With this configuration, it is possible to prevent unnecessary restriction of the operation of the vehicle body when the vehicle body gets away from the work area.

Through the same process, a correction amount for the entry-prohibited area is also calculated, and finally the smallest deceleration factor is outputted as a correction amount.

Next, in step S108, based on the required command and the correction amount, a target command for the flow rate control valve (corrected required command) is calculated and outputted (the required command correction section 41). Specifically, the value of the required command for the flow rate control valve is multiplied by the deceleration factor that is the correction value calculated in step S107, and the result is outputted as the target command for the flow rate control valve.

Next, in step S109, based on the target command (corrected required command) for the flow rate control valve, a control command for the flow rate control valve is outputted (the flow rate control valve control section 42). Specifically, the target command for the flow rate control valve is an opening area or displacement amount or drive pilot pressure of the flow rate control valve, and the flow rate control valve is controlled by the output of the solenoid proportional pressure reducing valve. In step S109, based on the target command for the flow rate control valve, a current value to be outputted to the solenoid proportional pressure reducing valve is calculated and outputted.

<Switching of Work Area Setting Mode by the Controller 25>

FIG. 22 is a monitor screen when a work area is set based on the position of a vehicle body. As described above, use of the switch 47 (FIG. 2) allows switching between a work area setting mode for setting a work area based on the design data 35 and a work area setting mode for setting a work area based on the position of the vehicle body irrespective of the design data 35. Setting a work area based on the design data 35 is performed as described above (see FIG. 7 to FIG. 14). When the work area setting mode is switched by the operation of the switch 47 to set a work area based on the position of the vehicle body, the work area setting screen is switched as shown in FIG. 22, and the operator sets a work area for restriction in the front, rear, right, and left directions by numerical values based on the center of rotation of the turning body 3. When no numerical value is set in a certain direction, the vehicle body is allowed to operate freely in that direction with no operational restriction. In addition, since the work area is set based on the position of the vehicle body, when the position of the vehicle body is changed through the traveling operation, operation of the work implement 7 at the front and the turning body 3 is restricted in the front, rear, right, and left directions by numerical values set based on the position of the vehicle body after traveling.

As described above, in setting a work area other than in the direction of gravity in the construction area (work area) or the vertical direction of the vehicle body, it is possible to switch between a work area setting mode for setting a work area based on the design data 35 and a work area setting mode for setting a work area based on the position of the vehicle body. With this configuration, when restriction of the operation of a work machine in some area is intended without traveling operation, such as digging and loading operation for earth and sand by the work machine, setting a work area based on the position of the vehicle body can simplify the work area setting process.

Although a work area and an entry-prohibited area are set by the controller 25 mounted on the hydraulic excavator 1 in the above embodiment, area restriction control may be implemented by transmitting to the hydraulic excavator 1 the work area and entry-prohibited area information set by an external server (or a controller thereof) or the like based on the design data 35.

Advantageous Effects

As described above, the work machine (hydraulic excavator) 1 of the present embodiment includes the controller 25 that performs area restriction control for restricting operation of the vehicle body so as to prevent the vehicle body from deviating from a work area set in a construction area. The controller 25 sets at least a part of the work area based on design data representing a final intended shape of a construction target in the construction area.

According to the present embodiment, provided is the work machine (hydraulic excavator) 1 including the controller 25 that performs area restriction control for preventing the vehicle body from deviating from the work area set in the construction area. In the work machine (hydraulic excavator) 1, it is possible to easily set an area for which operation of the work machine is to be restricted in an actual space to a desired position, and to avoid displacement of the area for which the work machine is to be actually controlled from the set area.

It should be noted that the present invention is not limited to the above embodiment and includes a variety of modifications. The above embodiment has been described in detail to clearly illustrate the present invention, and the present invention need not include all of the configurations described in the embodiment.

Some or all of the aforementioned functions of the controller of the embodiment may be implemented as hardware by designing them into an integrated circuit, for example. Alternatively, each of the functions may be implemented as software such that a processor analyzes and executes a program that implements each function. Information such as the program that implements each function, tables, and files may be stored in a recording device such as a hard disk, or a SSD (Solid State Drive) or a recording medium such as an IC card, an SD card, or a DVD, other than the storage unit in the controller.

REFERENCE SIGNS LIST

1 Hydraulic excavator (work machine)
2 Traveling body
3 Turning body
4 Cab
5 Machine room
6 Counterweight
7 Work implement
8 Boom
9 Arm
10 Bucket
11 Boom cylinder
12 Arm cylinder
13 Bucket cylinder
14 Turning motor
15*a* Left-side traveling motor
15*b* Right-side traveling motor
16 Hydraulic pump
17 Engine (prime mover)
18 Body inclination sensor
19 Boom inclination sensor
20 Arm inclination sensor
21 Bucket inclination sensor
22 Turning angle sensor
23 First GNSS antenna
24 Second GNSS antenna
25 Controller
26 Posture sensor
27 Communication device
28 Monitor
29 Control lever
30 Flow rate control valve unit
31 Turning flow rate control valve
32 Solenoid proportional pressure reducing valve unit
33*a* Leftward turning solenoid proportional pressure reducing valve
33*b* Rightward turning solenoid proportional pressure reducing valve
34 Pilot pump
35 Design data
36 Work area setting section
37 Entry-prohibited area setting section
38 Required command calculation section
39 Required speed calculation section
40 Required command correction amount calculation section
41 Required command correction section
42 Flow rate control valve control section
43 Work area of own machine
44 Entry-prohibited area of own machine
45 Work area of another machine
47 Switch (switching device)

The invention claimed is:

1. A work machine comprising a controller configured to perform area restriction control to prevent a vehicle body from deviating from a work area set in a construction area and avoid entry by the vehicle body into an entry-prohibited area, wherein the controller is configured to:

display, on a monitor screen, design data representing a final intended shape of a construction target in the construction area and, when a closed area selected from the design data includes a current position of the work machine from an input from the monitor screen, store in a storage unit as the work area the closed area including the position of the work machine;

when the closed area selected from the design data does not include the current position of the work machine from the input from the monitor screen, store in the storage unit as the entry-prohibited area, the closed area not including the position of the work machine;

when the closed area not including the position of the work machine includes at least a part of the work area that has already been stored in the storage unit, delete the work area from the storage unit, store in the storage unit as the entry-prohibited area the closed area not including the position of the work machine, and display the entry-prohibited area on the monitor screen; and according to a distance between a control point set to the vehicle body and a surface stored as the entry-prohibited area, calculate, as a correction amount, a deceleration factor indicating a degree of deceleration of a control command for a flow rate control valve that controls supply of hydraulic oil to an actuator that drives the vehicle body, correct the control command based on the calculated correction amount, and output the corrected control command to the flow rate control valve.

2. The work machine according to claim 1, wherein the controller is configured to set the work area other than in a direction of gravity in the work area or a vertical direction of the vehicle body based on the design data.

3. The work machine according to claim 1, wherein:

the design data is composed of a point cloud of coordinate points; and the controller is configured to set, as the work area, a closed area formed by a plurality of points selected from the point cloud.

4. The work machine according to claim 3, wherein the controller is configured to set, as the work area, the closed area formed by a plurality of points selected from the point cloud only when a current position of the work machine is included.

5. The work machine according to claim 1, wherein:

the design data is composed of a surface group including coordinate information; and the controller is configured to set, as the work area, at least one surface selected from the surface group.

6. The work machine according to claim 5, wherein the controller is configured to set in advance, as the work area, design data located below a current position of the work machine.

7. The work machine according to claim 1, wherein the controller is configured to prohibit setting, as the work area of an own machine, a work area that has already been set by another machine.

8. The work machine according to claim 1, wherein the controller can switch between a first work area setting mode for setting at least a part of the work area based on the design data and a second work area setting mode for setting the work area based on a position of the vehicle body irrespective of the design data.

9. The work machine according to claim 8, wherein the work machine includes a switching device for switching between the first work area setting mode and the second work area setting mode.

10. The work machine according to claim 1, wherein the controller is configured to set the work area other than in a direction of gravity in the work area or a vertical direction of the vehicle body based on the design data.

11. The work machine according to claim 1, wherein:

the design data is composed of a point cloud of coordinate points; and the controller is configured to set, as the work area, a closed area formed by a plurality of points selected from the point cloud.

12. The work machine according to claim 11, wherein the controller is configured to set, as the work area, the closed area formed by a plurality of points selected from the point cloud only when a current position of the work machine is included.

13. The work machine according to claim 1, wherein:

the design data is composed of a surface group including coordinate information; and the controller is configured to set, as a work area, at least one surface selected from the surface group.

14. The work machine according to claim 13, wherein the controller is configured to set in advance, as a work area, design data located below a current position of the work machine.

15. The work machine according to claim 1, wherein the controller is configured to prohibit setting, as a work area of an own machine, a work area that has already been set by another machine.

16. The work machine according to claim 1, wherein the controller can switch between a first work area setting mode for setting at least a part of the work area based on the design data and a second work area setting mode for setting the work area based on a position of the vehicle body irrespective of the design data.

17. The work machine according to claim 16, wherein the work machine includes a switching device for switching between the first work area setting mode and the second work area setting mode.

* * * * *